US010149539B2

(12) United States Patent
McGregor et al.

(10) Patent No.: US 10,149,539 B2
(45) **Date of Patent: *Dec. 11, 2018**

(54) UNDERMOUNT DRAWER SLIDE POSITION ADJUSTMENT APPARATUS AND METHOD OF USE

(71) Applicant: Hardware Resources, Inc., Bossier City, LA (US)

(72) Inventors: Dennis McGregor, Farmers Branch, TX (US); Greg Davis, Dallas, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,537

(22) Filed: Jun. 22, 2017

(65) Prior Publication Data

US 2017/0347794 A1 Dec. 7, 2017

Related U.S. Application Data

(63) Continuation-in-part of application No. 15/458,697, filed on Mar. 14, 2017, now Pat. No. 9,986,829, (Continued)

(51) Int. Cl.
*A47B 88/00* (2017.01)
*A47B 88/57* (2017.01)
(Continued)

(52) U.S. Cl.
CPC ..... *A47B 88/57* (2017.01); *A47B 88/407* (2017.01); *A47B 88/427* (2017.01); *A47B 88/49* (2017.01);
(Continued)

(58) Field of Classification Search
CPC ..... A47B 88/40; A47B 88/407; A47B 88/423; A47B 88/427; A47B 88/0407;
(Continued)

(56) References Cited

U.S. PATENT DOCUMENTS 139,228 A 5/1873 Arnold
808,927 A 1/1906 Hunn
(Continued)

FOREIGN PATENT DOCUMENTS

EP 0761132 3/1997
EP 1440631 7/2007
(Continued)

*Primary Examiner* — Daniel J Rohrhoff
(74) *Attorney, Agent, or Firm* — Schultz & Associates, P.C.

(57) ABSTRACT

An undermount drawer slide mounting clip releasably attaches a drawer to a drawer rail assembly mounted in a cabinet carcass. The apparatus is capable of effecting positional adjustments of the drawer in three directions without removing the drawer from the cabinet carcass. The apparatus is comprised of a body slidingly engaged with a bonnet. A trigger pivotally connected between the body and the bonnet. A spring loaded catch slidable within the bonnet and acted on by the trigger to releasably attach the apparatus to a drawer rail assembly. A threaded spindle rotates within the base and adjusts the horizontal position of the drawer. A ramp adjustably connected to the base adjusts the vertical position of the drawer. A plunger extends from a housing connected to the body to adjacent the drawer rail assembly and adjusts the depth of the drawer.

20 Claims, 27 Drawing Sheets

Related U.S. Application Data which is a continuation-in-part of application No. 15/231,573, filed on Aug. 8, 2016, now Pat. No. 9,782,001, which is a continuation of application No. 14/821,979, filed on Aug. 10, 2015, now Pat. No. 9,408,463, which is a continuation of application No. 14/088,053, filed on Nov. 22, 2013, now Pat. No. 9,101,213.

(51) Int. Cl.
*A47B 88/49* (2017.01)
*A47B 88/407* (2017.01)
*A47B 88/427* (2017.01)

(52) U.S. Cl.
CPC ..... *A47B 2088/4276* (2017.01); *A47B 2088/4278* (2017.01); *A47B 2210/091* (2013.01); *Y10T 29/4984* (2015.01)

(58) Field of Classification Search
CPC ..... A47B 88/0418; A47B 88/0422; A47B 88/044; A47B 2088/4235; A47B 2088/4274; A47B 2088/4276; A47B 2088/4778; A47B 2210/0054
See application file for complete search history.

(56) References Cited

U.S. PATENT DOCUMENTS

| | | | |
|---|---|---|---|
| 4,441,773 | A | 4/1984 | Leiper |
| 5,306,080 | A | 4/1994 | Lautenschlager et al. |
| 5,580,139 | A | 12/1996 | Grabher |
| 5,588,729 | A | 12/1996 | Berger |
| 6,027,193 | A | 2/2000 | Domenig et al. |
| 6,837,557 | B2 | 1/2005 | Domenig |
| 6,913,334 | B2 | 7/2005 | Weichelt |
| 7,549,712 | B2 | 6/2009 | Booker et al. |
| 7,695,080 | B2 | 4/2010 | Chen et al. |
| 8,016,374 | B2 | 9/2011 | Kropf et al. |
| 8,056,994 | B2 | 11/2011 | Chen et al. |
| 8,336,973 | B2 | 12/2012 | Berger |
| 8,424,984 | B2 | 4/2013 | Ritter |
| 8,696,078 | B2 | 4/2014 | Gasser |
| 8,727,460 | B2 | 5/2014 | Grabher |
| 8,764,136 | B2 | 7/2014 | Grabherr |
| 8,991,952 | B2 | 3/2015 | Salice |
| 9,101,213 | B2 | 8/2015 | McGregor |
| 2002/0158557 | A1 | 10/2002 | Weichelt |
| 2004/0239219 | A1 | 12/2004 | Kim et al. |
| 2009/0167128 | A1 | 7/2009 | Berger |
| 2009/0212679 | A1 | 8/2009 | Frousiakis et al. |
| 2009/0236959 | A1 | 9/2009 | Liang et al. |
| 2009/0239219 | A1 | 9/2009 | Andrews |
| 2012/0017414 | A1 | 1/2012 | Cerniglia |
| 2012/0176015 | A1 | 7/2012 | Liang et al. |
| 2012/0292465 | A1 | 11/2012 | Holzer et al. |
| 2013/0257244 | A1 | 10/2013 | Salice |
| 2014/0015390 | A1 | 1/2014 | Grabherr |
| 2014/0314347 | A1 | 10/2014 | Huang |
| 2014/0314374 | A1 | 10/2014 | Fattal |
| 2017/0181544 | A1* | 6/2017 | McGregor ..... A47B 88/407 |

FOREIGN PATENT DOCUMENTS

| | | |
|---|---|---|
| EP | 2208442 | 7/2010 |
| GB | 2095537 | 10/1982 |
| GB | 2440306 | 1/2006 |
| WO | 2012069337 | 5/2012 |

* cited by examiner

UNDERMOUNT DRAWER SLIDE POSITION ADJUSTMENT APPARATUS AND METHOD OF USE

CROSS REFERENCE TO RELATED APPLICATIONS

This application is a Continuation In Part of application Ser. No. 15/458,697, filed Mar. 14, 2017, which is a Continuation In Part of application Ser. No. 15/231,573, filed Aug. 8, 2016, which is a Continuation of application Ser. No. 14/821,979, filed Aug. 10, 2015, now U.S. Pat. No. 9,408,463, which is a Continuation of application Ser. No. 14/088,053, filed Nov. 22, 2013, now U.S. Pat. No. 9,101,213. Each patent application identified above is incorporated here by reference in its entirety to provide continuity of disclosure.

FIELD OF INVENTION

This disclosure relates to the field of drawer slides for mounting drawers in cabinetry. More particularly this disclosure relates to an undermount drawer slide mounting clip for releasably coupling a drawer to a drawer slide assembly.

BACKGROUND

Drawer slide assemblies include slides or rails mounted on both the cabinet carcass and the drawer. The slides attached to the drawer cooperate with the slides mounted to the cabinet carcass to allow telescoping extensions while providing support for the drawer. Drawer slides typically are mounted either underneath the drawer or on the sides of a drawer. Both the undermount drawer slide and the side-mount drawer slide styles offer different advantages. A desirable advantage of the undermount drawer slide is that it is not visible when a drawer is open and the slide is extended. To consumers, the appearance of the drawer is enhanced.

Adjustment of the drawer face of a drawer mounted using an undermount drawer slide assembly is also important to appearance. Overcoming misalignment of an installed drawer relative to the cabinet and any adjacent drawers due to manufacturing tolerances is necessary. Adjustments are often necessary in three directions, "horizontal", "vertical", and "depth".

Releasable coupling devices which allow a drawer to be fitted to an extendable rail of a drawer assembly are known in the art.

U.S. Pat. No. 6,913,334 to Weichelt discloses a device for establishing an adjustable connection between a drawer and a furniture guide rail. The device comprises a base part adapted for connection to the drawer and a detent recess adapted for connection to the guide rail. The tolerance between the drawer and the guide rail may be manually adjusted in two directions and the furniture guide rail must include a suitable detent for engagement with the detent recess.

U.S. Pat. No. 8,424,984 to Ritter discloses an apparatus for releasably coupling a drawer to a drawer pull-out guide. The apparatus comprises a holding part which interacts with a mating part of the guide rail. A region of the holding part which comes in contact with the mating part of the guide rail is flexible to compensate any longitudinal play of the drawer in relation to the rail. In addition to the flexible depth compensation, the apparatus provides the capability of a "horizontal" adjustment.

U.S. Patent Application Publication No. 2012/0292465 to Holzer, et al. discloses a coupling device for a drawer. The device comprises a fixing portion mounted to the drawer and a coupling portion for releasably interacting with the guide rail. The device is capable of providing an adjustment in a "vertical" direction and a "horizontal" direction.

However, a simple, cost effective, and easy to operate solution providing a quick, releasable engagement to an existing drawer slide assembly capable of providing three directional adjustments is needed. Further, there is a need for an easily operated undermount drawer slide mounting clip capable of releasbly coupling a drawer to a drawer slide assembly and providing three-directional adjustment that can be operated by hand without removing the drawer from the cabinet carcass.

SUMMARY

The apparatus disclosed is an undermount drawer slide clip mounting apparatus configured to releasably attach a drawer to a drawer slide assembly mounted in a cabinet carcass and capable of effecting adjustments in three directions without removing the drawer from engagement with the cabinet.

Accordingly, the drawer slide assembly is comprised of a cabinet rail mounted to the cabinet carcass, an intermediate rail slidingly engaged with the cabinet rail, and a drawer rail slidingly engaged with the intermediate rail. The undermount drawer slide clip mounting apparatus is comprised of a body including a base slidingly engaged with a bonnet. A lever arm is pivotally engaged with the body and a spring loaded catch is slidable within the bonnet. A threaded spindle rotates within the base and affects the lateral position of the bonnet relative to the base. A height adjusting ramp is adjustably connected to the base. A depth adjuster is connected to the base and includes a lever pivotal within a housing and a cover. The lever includes gear teeth engaged with gear teeth on a plunger extending from the housing.

The base of the undermount drawer slide clip is mounted to the underside of a drawer. A trigger moves the catch for releasable engagement with the drawer rail of the drawer slide assembly. The drawer rail further engages the ramp. The position of the ramp relative to the base can be adjusted to affect the vertical position of the drawer. Rotation of the spindle moves the lateral position of the bonnet relative to the base and thus imparts a lateral adjustment of the drawer. When the drawer is closed, the cabinet rail of the drawer slide assembly contacts the plunger. Pivoting the lever moves the position of the plunger and provides a depth adjustment.

In an alternate embodiment, a depth adjuster is connected to the base and includes a plunger slidable within a housing. A thumbwheel contained within the housing is threadably engaged with the plunger. Rotating the thumbwheel moves the position of the plunger and provides a depth adjustment.

BRIEF DESCRIPTION OF DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

DETAILED DESCRIPTION OF PREFERRED EMBODIMENTS

Figure 1:
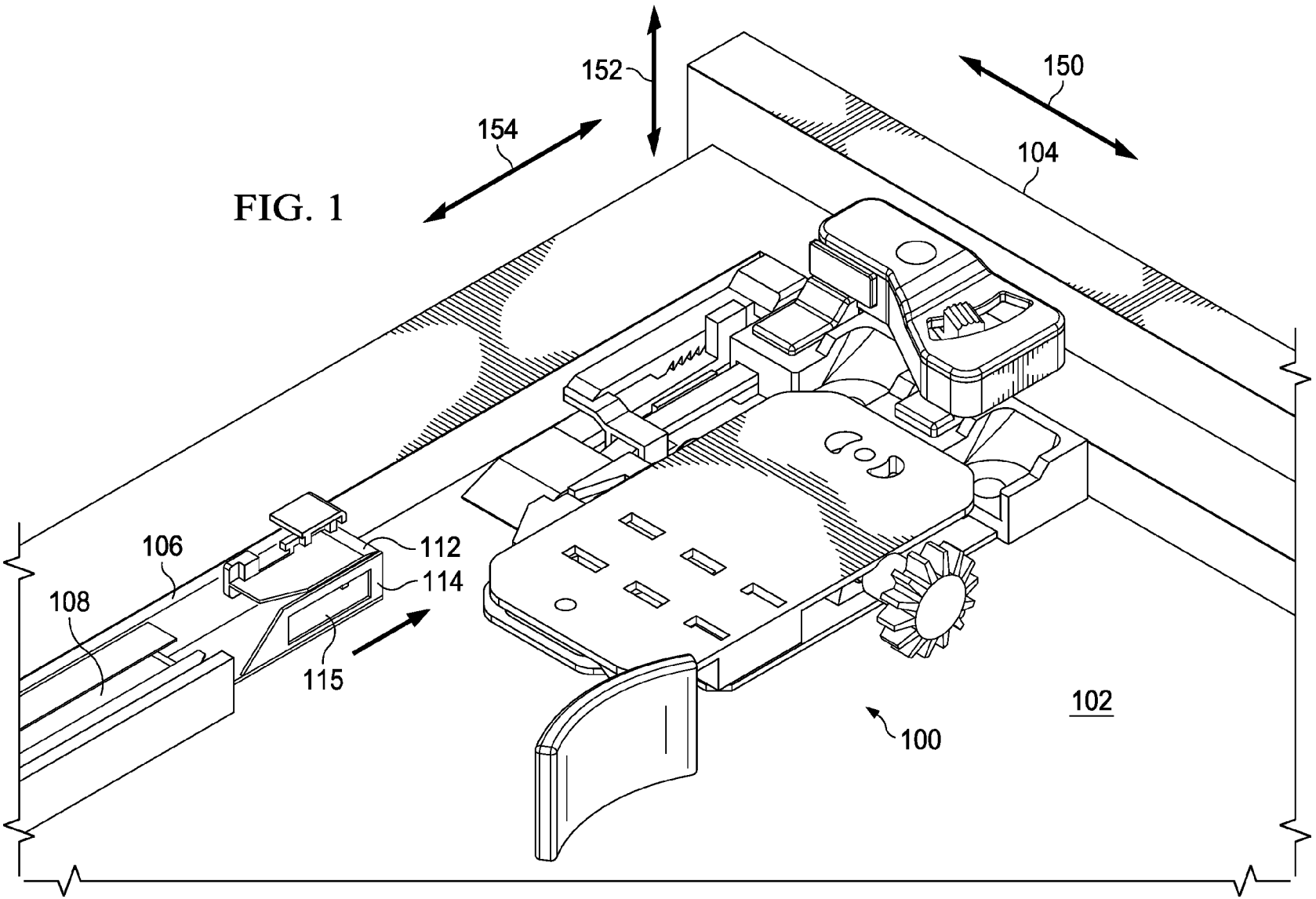
FIG. 1 is an isometric view of a preferred embodiment attached to the underside of a drawer.
Figure 6A:
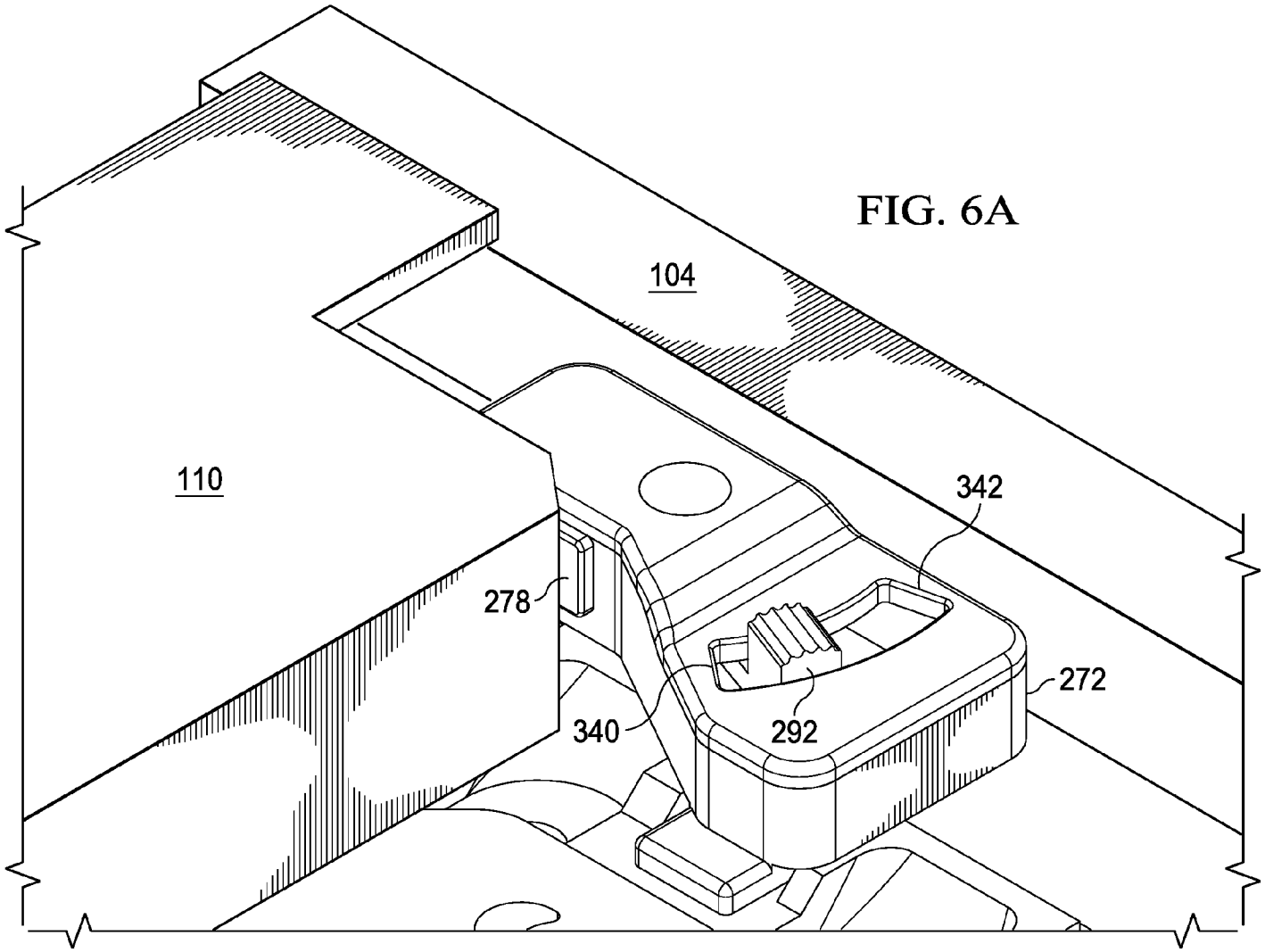
FIG. 6A is an isometric view of a preferred embodiment of the depth adjuster.
Figure 6B:
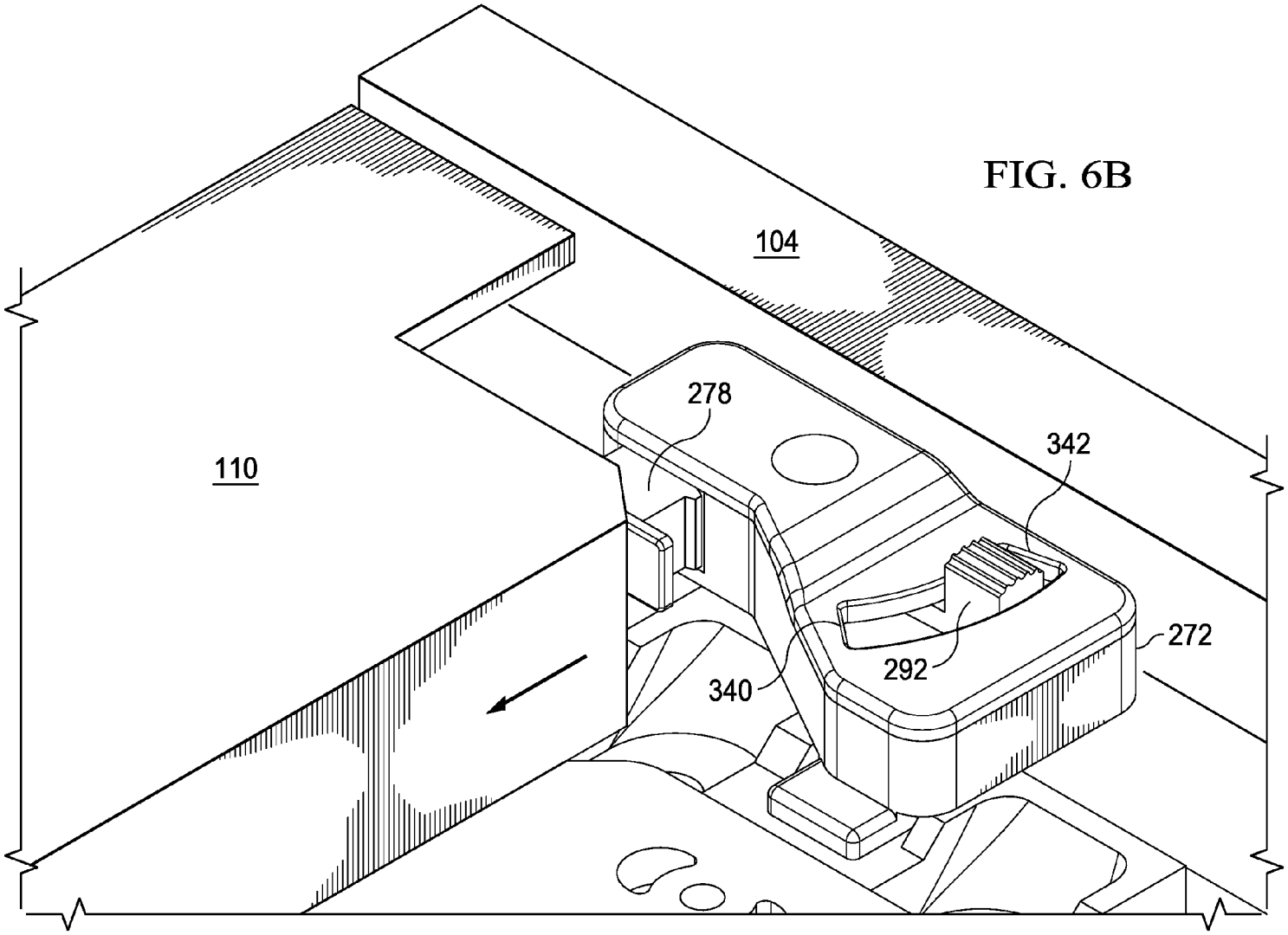
FIG. 6B is an isometric view of a preferred embodiment of the depth adjuster.

Referring to FIG. 1, the underside of drawer 102 is shown. Undermount drawer slide clip mounting apparatus 100 is mounted on the underside of the drawer adjacent drawer face 104. The front mounted location allows for easy adjustment by hand without disengaging the drawer from the drawer slide assembly. The drawer slide assembly is comprised of three slidingly engaged rails as is common in the art. Drawer rail 106 is removably engaged with undermount drawer slide clip mounting apparatus 100 and slidingly engaged with intermediate rail 108. Intermediate rail 108 is slidingly engaged with cabinet rail 110 (FIGS. 6A and 6B). Cabinet rail 110 is mounted to the cabinet carcass with conventional mounting hardware such as wood screws. Drawer rail 106 includes tab 114 and is further fitted with shoe 112. Tab 114 defines slot 115. Both shoe 112 and tab 114 are positioned on the front end of drawer rail 106. The undermount drawer slide clip mounting apparatus 100 allows adjustment in horizontal direction 150, vertical direction 152, and depth direction 154. It is envisioned that both "right hand" and "left hand" versions of the undermount drawer slide clip will be made. The left hand version is shown and described here. In a preferred embodiment, the left hand and right hand versions will include similar mirror image parts so that the apparatus will fit in the opposite corner of the drawer and attach to the opposite drawer rail.

Figure 2:
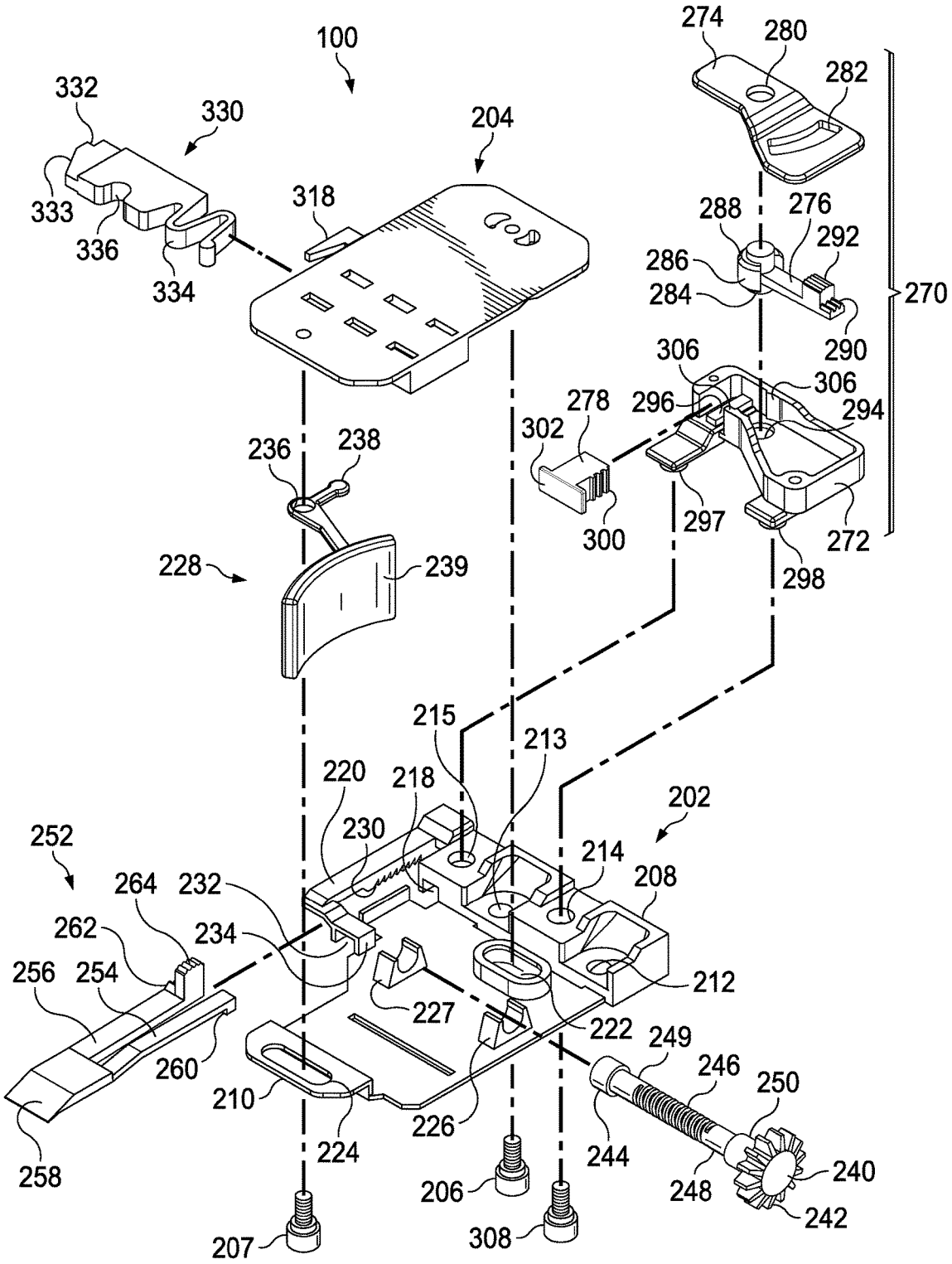
FIG. 2 is an exploded isometric view of a preferred embodiment.
Figure 3:
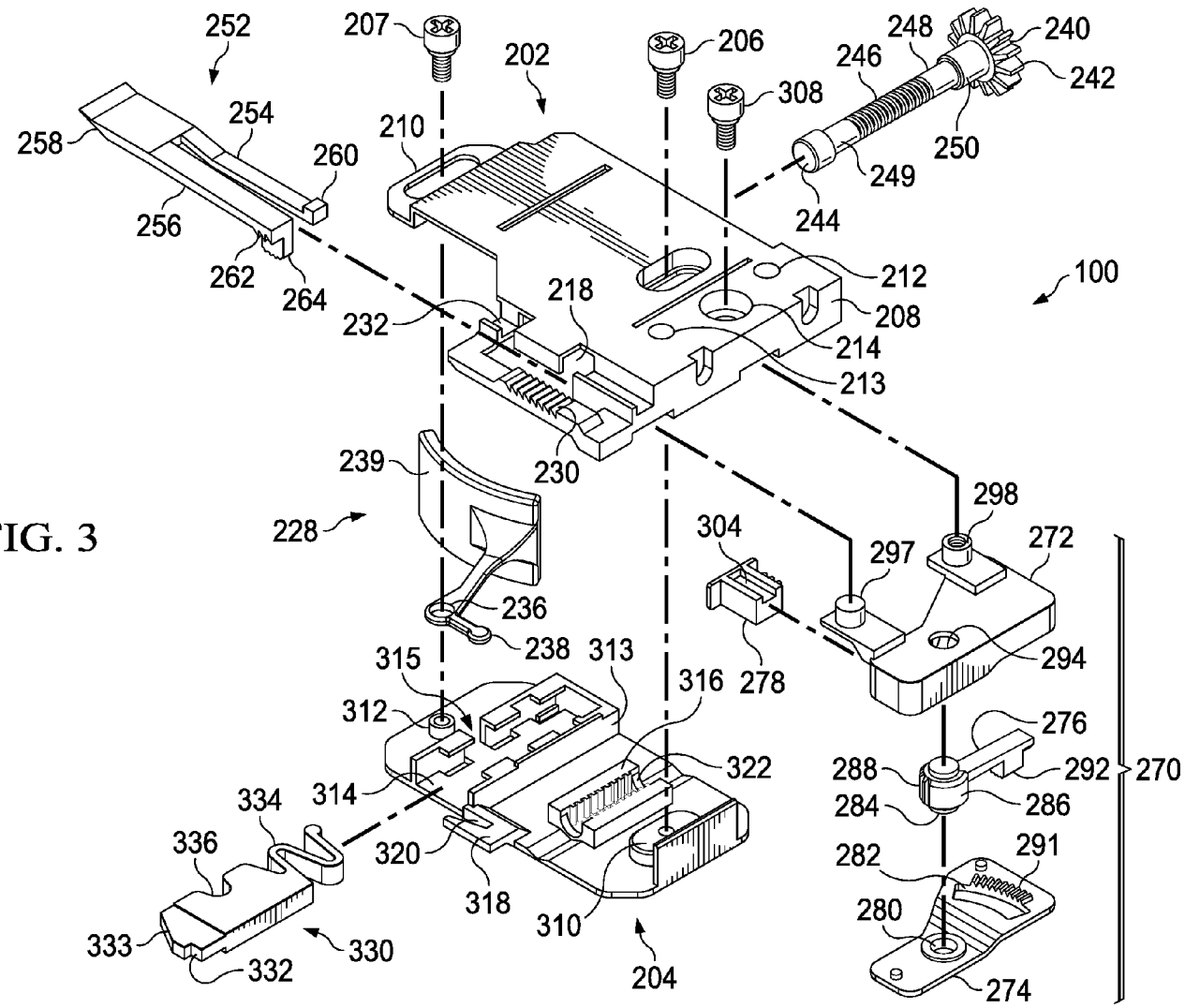
FIG. 3 is an exploded isometric view of a preferred embodiment.

Referring to FIGS. 2 and 3, undermount drawer slide clip mounting apparatus 100 is comprised of base 202 slidingly engaged with bonnet 204. Base 202 is a generally flat, rectangular plate rigidly mounted to the underside of the drawer with conventional mounting hardware such as wood screws through holes 212 and 213. Base 202 includes ends 208 and 210. End 208 is mounted adjacent drawer face 104. End 208 includes holes 214 and 215. Hole 214 passes completely though base 202 while hole 215 may or may not pass completely through. Recess 218 is a rectangular shaped cutout beneath hole 215.

Saddles 226 and 227 project from base 202 near the longitudinal midpoint of base 202. Bridge 220 extends from end 208 adjacent hole 215, projects along an edge of base 202, and reconnects to base 202 adjacent saddle 227 forming block 234. Bridge 220 includes teeth 230 and recess 232. Oblong hole 222 passes through base 202 proximate saddles 226 and 227. Oblong hole 224 is formed in base 202 at end 210. Spindle 240 is a threaded shaft with knob 242 adjacent collar 250 on one end and barrel 244 on the opposite end. Spindle 240 has threaded section 246 flanked by two bare sections 248 and 249. Bare sections 248 and 249 are seated in saddles 226 and 227 respectively. Collar 250 is adjacent saddle 226. Barrel 244 is adjacent saddle 227.

Height adjuster 252 is adjustably engaged with base 202 at bridge 220. Height adjuster 252 is comprised of arms 254 and 256 extending generally parallel to each other from ramp 258. Opposite ramp 258, arm 254 includes hook 260. Opposite ramp 258, arm 256 includes teeth 262 adjacent extension 264. Teeth 262 are sized to engage teeth 230 and hook 260 is sized to engage recess 218.

Lever arm 228 is generally elbow shaped and comprised of strike 238 on one end and trigger 239 on an opposite end. Pivot hole 236 is displaced between the ends at the elbow bend. Lever arm 228 is pivotally connected between base 202 and bonnet 204 with screw 207 through pivot hole 236.

Bonnet 204 is a generally flat, rectangular plate slidingly engaged with base 202. Screws 206 and 207 affix bonnet 204 to base 202 through oblong holes 222 and 224 respectively. Stanchions 310 and 312 extend from bonnet 204. Each stanchion includes a hole to receive screws 206 and 207. The generally rectangular, hollow shape of box 313 forms channel 314 adjacent stanchion 312. One side wall of box 313 includes gap 315. Block 316 is positioned adjacent stanchion 310 and includes threaded slot 322. The threads of threaded slot 322 are sized to engage threaded section 246 of spindle 240. Arm 318 extends from bonnet 204 and further includes slot 320. The longitudinal axes of channel 314 and threaded slot 322 are generally parallel to each other and generally perpendicular to the longitudinal axis of slot 320. In the preferred embodiment, stanchions 310 and 312, box 313, block 316, and arm 318 are all integrally formed with bonnet 204.

Catch 330 is sized to be slidably engaged with channel 314. Catch 330 includes notch 332 adjacent angled edge 333 on a first end and spring 334 on an opposite end. Disposed between the two ends of catch 330 is slot 336. Slot 336 is sized to accommodate strike 238 of lever arm 228.

Figure 5:
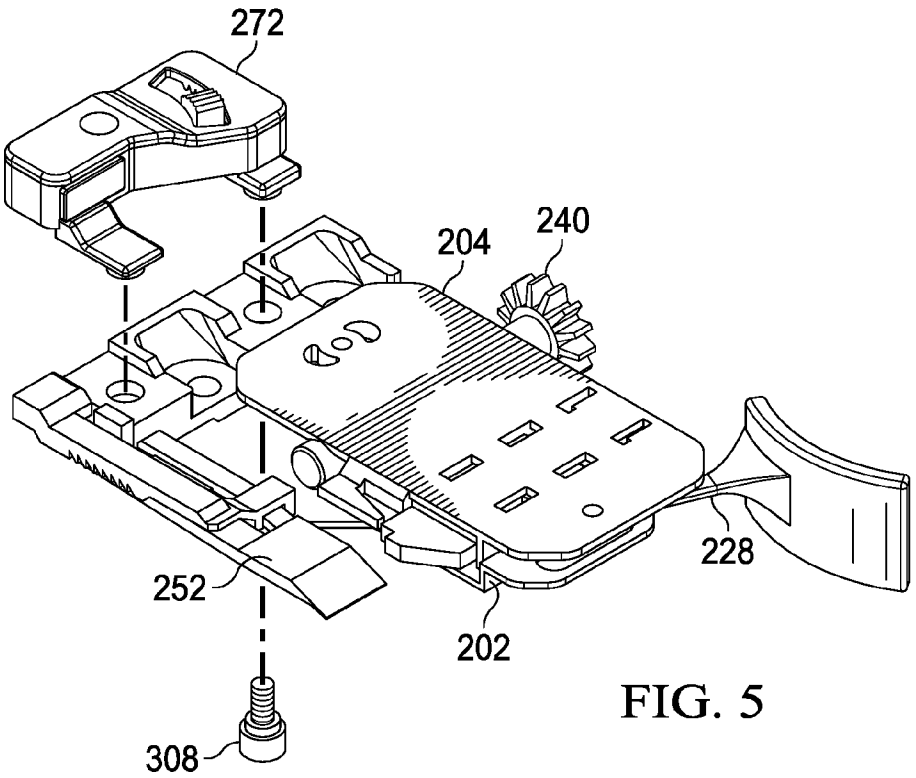
FIG. 5 is a partially exploded isometric view of a preferred embodiment showing attachment of the depth adjuster.
Figure 4:
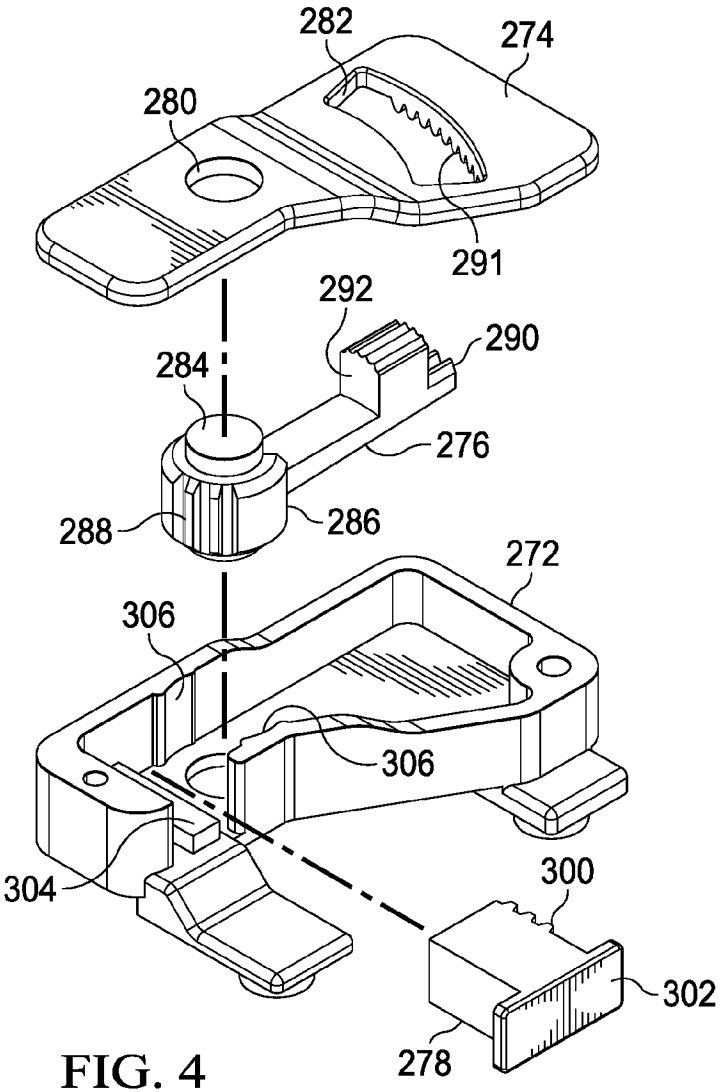
FIG. 4 is an exploded isometric view of a preferred embodiment of the depth adjuster.

Referring additionally to FIGS. 4 and 5, depth adjuster 270 is comprised of housing 272 fitted with cover 274. Housing 272 has a generally rectangular shaped, hollow body including pivot hole 294. Stanchions 297 and 298 extend from one side of housing 272. Stanchion 298 includes a hole sized to receive screw 308. Adjacent pivot hole 294 is rib 296. Partially surrounding pivot hole 294 and integrally formed into opposing sidewalls of housing 272 are arcuate guides 306.

Cover 274 is a Z-shaped, generally rectangular plate releasably fitted to housing 272. Cover 274 includes pivot hole 280 and arcuate slot 282. Adjacent arcuate slot 282, cover 274 further includes an arcuate strip of teeth 291. Lever 276 includes axel 284 on a first end and teeth 290 adjacent extension 292 on its opposite end. Teeth 290 are sized to engage teeth 291. Lever 276 is pivotally engaged with housing 272 and cover 274 by axel 284 through pivot holes 294 and 280. Surrounding axel 284 is collar 286. Collar 286 is sized to rotate freely between arcuate guides 306 and further includes teeth 288. Plunger 278 has a hollow, T-shaped body where face 302 is positioned along the top of the "T". Plunger 278 further includes slot 304 sized to accommodate rib 296 of housing 272 and teeth 300 sized to engage teeth 288 of lever 276.

Depth adjuster 270 is rigidly connected to base 202 by screw 308 through hole 214 and the hole in stanchion 298. Stanchion 297 is fitted to hole 215.

In the preferred embodiment, components of undermount drawer slide clip mounting apparatus 100 including base 202, bonnet 204, lever arm 228, spindle 240, height adjuster 252, depth adjuster 270, and catch 330 are manufactured of a molded plastic such as polystyrene, PVC (polyvinyl chloride), or nylon.

In use, undermount drawer slide clip mounting apparatus 100 is affixed to the underside of the drawer, adjacent drawer face 104, with screws through holes 212 and 213. To releasably clip the drawer to drawer rail 106, lever arm 228 is pivoted about pivot hole 236 by applying a force to trigger 239 in a direction generally parallel to the bottom surface of the drawer towards the drawer slide assembly. Trigger 239 is sized and shaped to be manipulated by hand without tools. Strike 238 projects through gap 315, abuts catch 330 within slot 336, and slides catch 330 within channel 314 against the bias of spring 334. Tab 114 of drawer rail 106 is slidingly inserted into slot 320 and the front end of drawer rail 106 slides over ramp 258 on height adjuster 252. Trigger 239 is released allowing notch 332 to pass through slot 115 and under shoe 112. Angled edge 333 assists in the alignment of notch 332 with slot 115.

To adjust the vertical position of the drawer relative to the cabinet carcass, a force is applied to extension 264 in a direction towards the bottom of the drawer. Teeth 262 are released from their engagement with teeth 230. As long as teeth 262 and teeth 230 are disengaged, height adjuster 252 is free to slide relative to base 202 in a direction generally parallel with the opening and closing direction of the drawer. Sliding height adjuster 252 towards drawer rail 106 causes the front end of drawer rail 106 to move up ramp 258 and thus the drawer in an upward direction relative to the cabinet carcass. Sliding height adjuster away from drawer rail 106 causes the front end of drawer rail 106 to move down ramp 258 and thus the drawer in a downward direction relative to the cabinet carcass. Hook 260 engaged with recess 218 limits the sliding movement of height adjuster 252 and prevents height adjuster 252 from becoming disengaged with base 202. Once the desired drawer height is reached, the force on extension 264 is released and teeth 262 reengage teeth 230.

To adjust the horizontal position of the drawer relative to the cabinet carcass, a rotational force is applied to spindle 240 via knob 242. During rotation, the spindle's horizontal position relative to base 202 is prevented from changing by barrel 244 abutting saddle 227 and collar 250 abutting saddle 226. Threaded section 246 interacts with threaded slot 322. As spindle 240 rotates, bonnet 204 moves horizontally with respect to base 202. Drawer rail 106 is releasably clipped to bonnet 204 via arm 318 and slot 320. Once the desired horizontal position is reached, rotation of spindle 240 is stopped.

As shown in FIGS. 6A and 6B, when the drawer is in a closed position, cabinet rail 110 abuts face 302 on plunger 278. The position of plunger 278 and thus face 302 determines the depth of the drawer relative to the cabinet carcass. To adjust the depth the drawer closes to relative to the cabinet carcass, plunger 278 is extended from or retracted within housing 272. As plunger 278 extends from housing 272, the closed position of the drawer relative to the cabinet carcass is extended further out of the cabinet carcass. To extend plunger 278 out of housing 272, a force is applied to extension 292 to release teeth 290 from engagement with teeth 291. Once the teeth are disengaged, lever 276 is pivoted about pivot hole 280 via axel 284. Rotation of collar 286 is confined by arcuate guides 306. Teeth 288 engaged with teeth 300 convert the rotational movement of lever 276 into linear movement of plunger 278. Movement of extension 292 from point 340 to point 342 translates into extending plunger 278 from housing 272 resulting in a closed position where the position of the drawer relative to the cabinet carcass is extended further out of the cabinet carcass. Movement of extension 292 from point 342 to point 340 translates into retracting plunger 278 back into housing 272 resulting in a closed position where the position of the drawer relative to the cabinet carcass is retracted, or less extended out of the cabinet carcass. Once the desired depth is achieved, the force on extension 292 is removed and teeth 290 reengage with teeth 291. It is understood that extension 292 may also be positioned anywhere between points 340 and 342 along arcuate slot 282 to effect different drawer closing depths.

Figure 7:
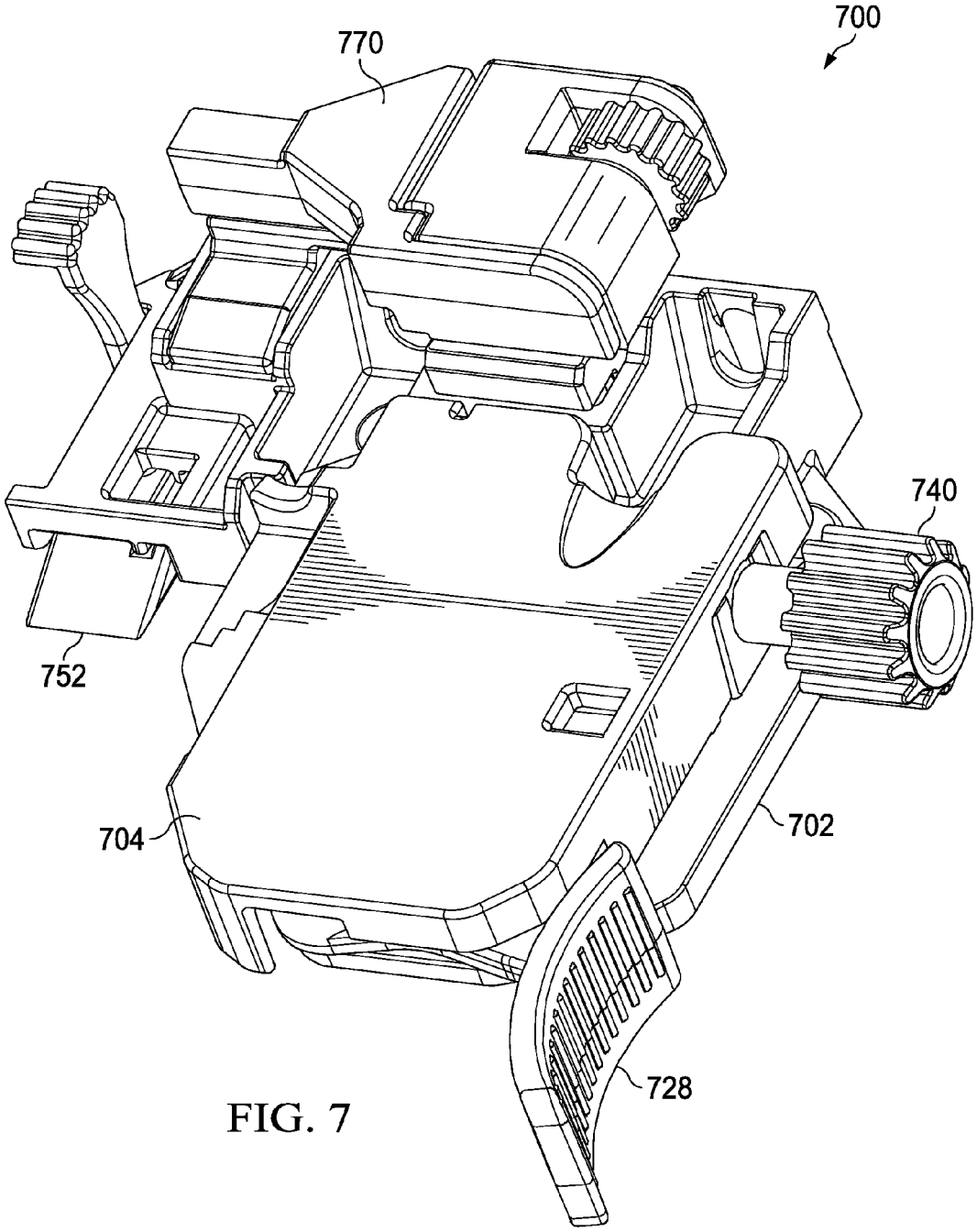
FIG. 7 is an isometric view of an alternate embodiment.
Figure 8:
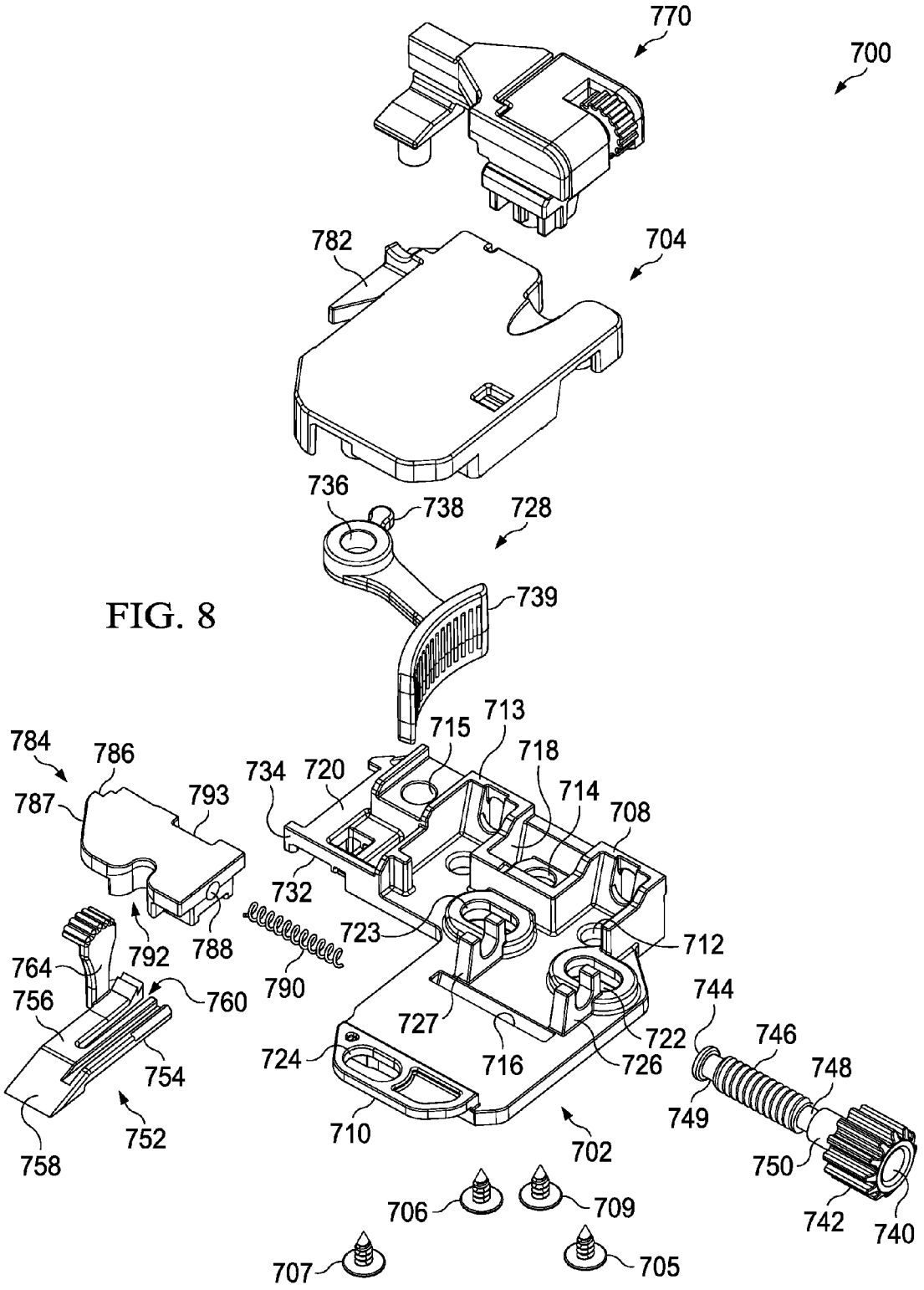
FIG. 8 is an exploded isometric view of an alternate embodiment.
Figure 9:
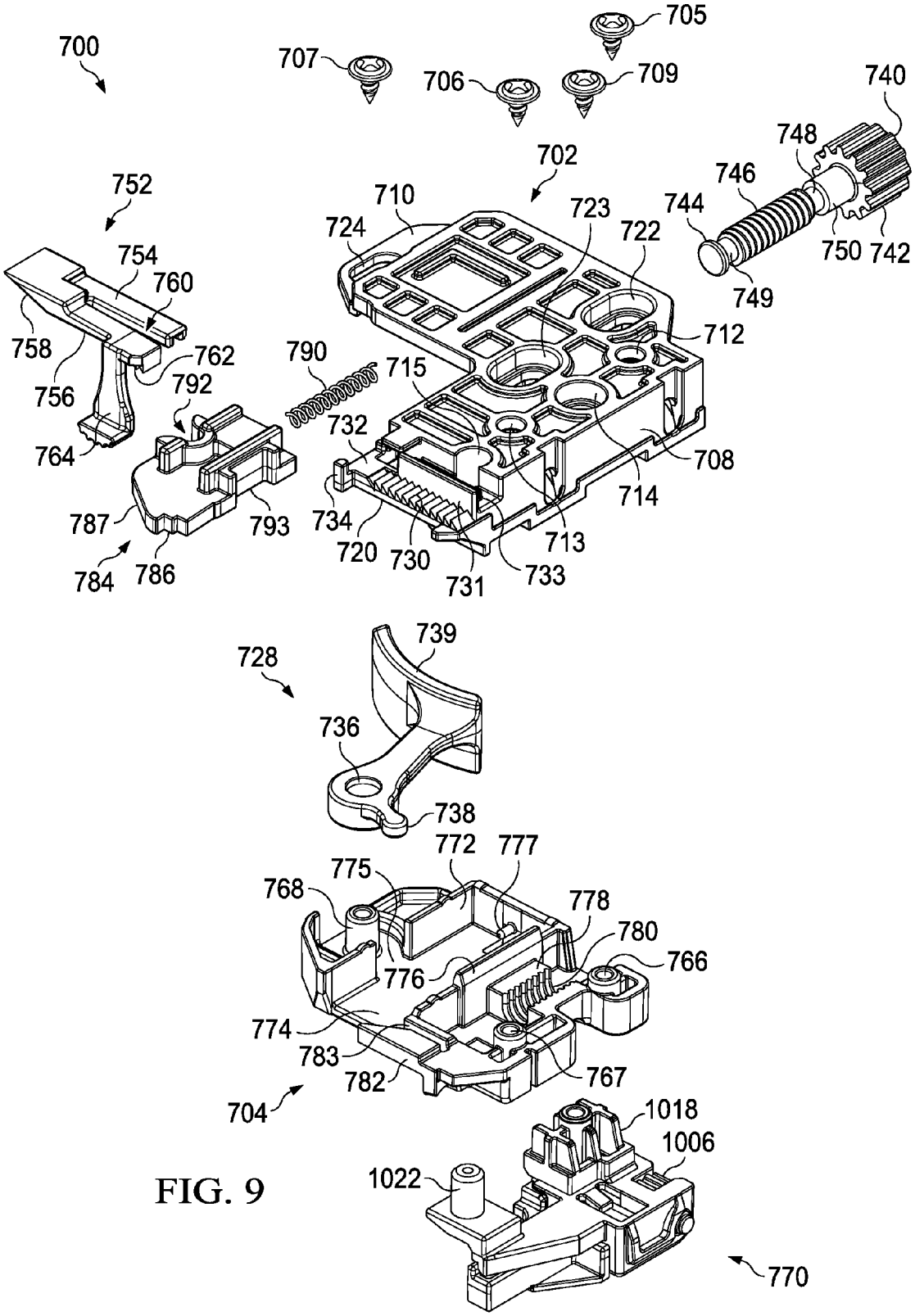
FIG. 9 is an exploded isometric view of an alternate embodiment

Referring to FIGS. 7-9, an alternate embodiment, undermount drawer slide clip mounting apparatus 700 is shown. Undermount drawer slide clip mounting apparatus 700 comprises base 702 slidingly engaged with bonnet 704. Base 702 is a generally flat, rectangular plate rigidly mounted to the underside of the drawer with conventional mounting hardware such as wood screws through holes 712 and 713. Base 702 includes ends 708 and 710. End 708 includes holes 714 and 715. Hole 714 is centered within rectangular shaped recess 718.

Saddles 726 and 727 project from base 702 near the longitudinal midpoint of base 702. Slot 716 extends between saddles 726 and 727 adjacent both saddles. Bridge 720 extends from end 708 adjacent hole 715 forming block 734. Bridge 720 includes teeth 730. Block 734 includes recess 732. Ridge 731 extends from base 702 adjacent teeth 730. Slot 733 is formed in base 702 adjacent ridge 731 and leads to recess 732. Oblong holes 722 and 723 pass through base 702 proximate saddles 726 and 727, respectively. Oblong hole 724 is formed in base 702 at end 710.

Spindle 740 is a threaded shaft with knob 742 adjacent collar 750 on one end and tip 744 on the opposite end. Spindle 740 has threaded section 746 flanked by two bare sections 748 and 749. Bare sections 748 and 749 are seated in saddles 726 and 727 respectively. Collar 750 is adjacent saddle 726. Tip 744 is adjacent saddle 727.

Height adjuster 752 is adjustably engaged with base 702 at bridge 720. Height adjuster 752 is comprised of arms 754 and 756 extending generally parallel to each other from ramp 758 separated by slot 760. Arm 754 is sized to slidingly engage slot 733. Opposite ramp 758, arm 756 includes teeth 762 adjacent extension 764. Teeth 762 are sized to engage teeth 730. Slot 760 is sized to slidingly engage ridge 731.

Bonnet 704 is a generally flat, rectangular plate slidingly engaged with base 702. Screws 705, 706, and 707 affix bonnet 704 to base 702 through oblong holes 722, 723, and 724 respectively. Stanchions 766, 767, and 768 extend from bonnet 704. Each stanchion includes a hole to receive screws 705, 706, and 707. The generally rectangular, hollow shape of box 772 forms channel 774 adjacent stanchion 768. One side wall of box 772 includes gap 775. Another side wall of box 772 includes ridge 776. Ridge 776 is sized to slidingly engage slot 716. Protrusion 777 extends into channel 774 from an end wall of box 772. Block 778 is positioned adjacent stanchions 766 and 767 and includes threaded slot 780. The threads of threaded slot 780 are sized to engage threaded section 746 of spindle 740. Arm 782 extends from bonnet 704 and further includes slot 783. The longitudinal axes of channel 774 and threaded slot 780 are generally parallel to each other and generally perpendicular to the longitudinal axis of slot 783.

Lever arm 728 is generally elbow shaped and comprises strike 738 on one end and trigger 739 on an opposite end. Pivot hole 736 is displaced between the ends at the elbow bend. Lever arm 728 is pivotally connected between base 702 and bonnet 704 with screw 707 through pivot hole 736.

Catch 784 is sized to slidably engage channel 774. Catch 784 includes notch 786 adjacent angled edge 787 on a first end and spring hole 788 on an opposite end. Spring hole 788 is sized to accept spring 790. Spring 790 further engages protrusion 777. Spring 790 biases catch 784 out of channel 774 in a direction generally parallel to the bottom surface of the drawer towards the drawer slide assembly. Disposed between the two ends of catch 784 is slots 792 and 793. Slot 792 is sized to accommodate strike 738 of lever arm 728. Slot 793 slidingly engages a tab extending from ridge 776 to limit the longitudinal travel of catch 784 through channel 774.

Figure 10:
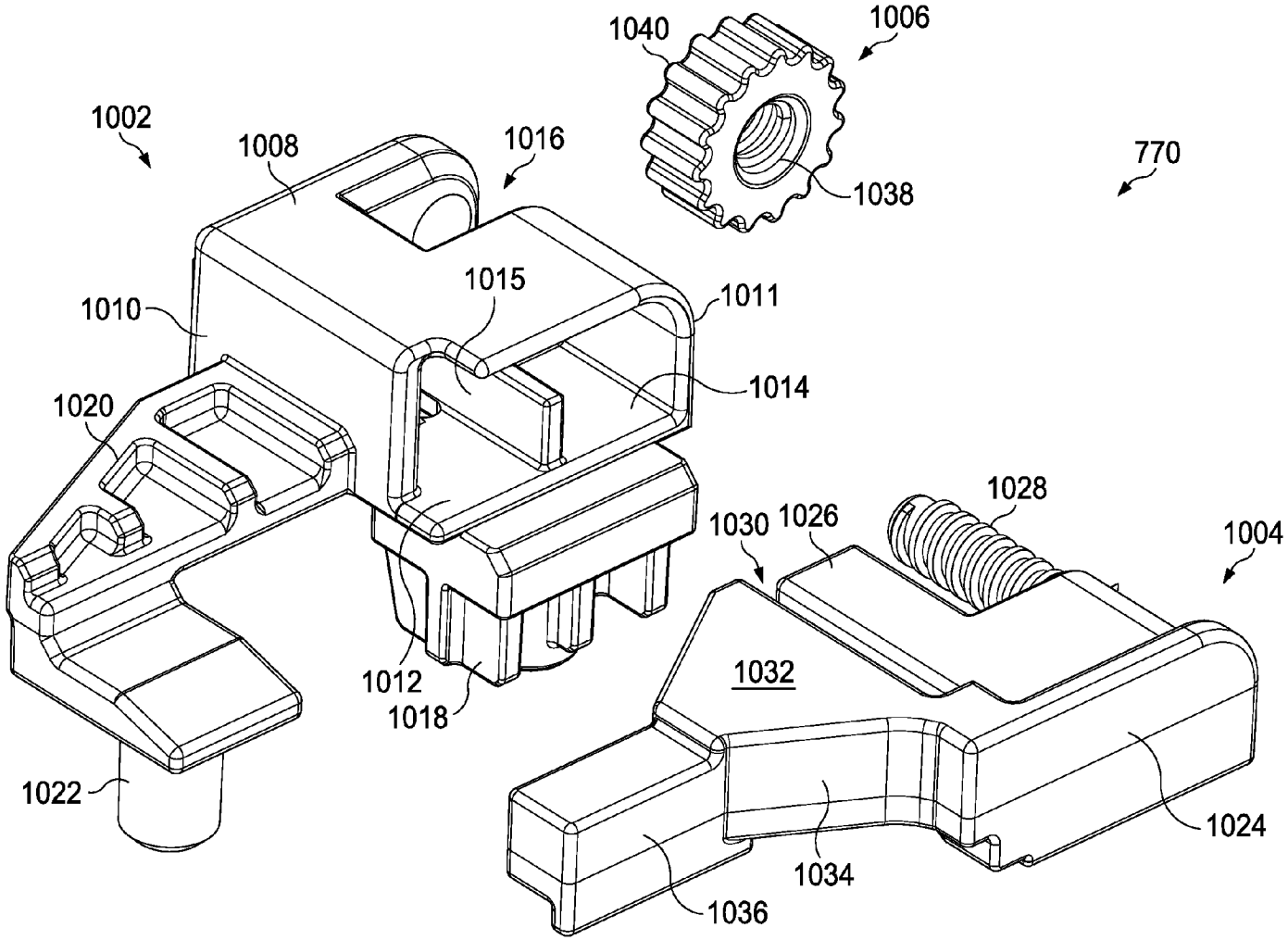
FIG. 10 is an isometric view of an alternate embodiment of the depth adjuster.

Referring additionally to FIG. 10, depth adjuster 770 comprises housing 1002 slidingly engaged with plunger 1004. Thumbwheel 1006 is constrained by housing 1002 and operatively engaged with plunger 1004.

Housing 1002 includes body 1008 having opposing side walls 1010 and 1011. Channel 1012 is adjacent side wall 1010 within body 1008. Channel 1014 is adjacent side wall 1011 within body 1008. Channel 1012 is separated from channel 1014 by ridge 1015. Side wall 1011 includes notch 1016. Notch 1016 leads to channel 1014 and is sized to accept thumbwheel 1006. Stanchion 1018 extends from body 1008 proximate channels 1012 and 1014. Stanchion 1018 includes a hole sized to receive screw 709. Arm 1020 extends from side wall 1010 proximate channel 1012. Arm 1020 includes stanchion 1022.

Plunger 1004 comprises prong 1026 and threaded shaft 1028 extending from bridge 1024. Prong 1026 is sized to slidingly engage channel 1012 between side wall 1010 and ridge 1015. Threaded shaft 1028 is generally parallel with prong 1026 and is sized to engage channel 1014. Adjacent prong 1026 is slot 1030. Slot 1030 is sized to slidingly accept side wall 1010. Prong 1026 engaged with channel 1012 prevents rotational movement of plunger 1004 with respect to housing 1002. Arm 1032 extends from bridge 1024. Arm 1032 includes angled surface 1034 and face 1036. Face 1036 is a flat surface generally perpendicular to the direction of travel of the drawer slide assembly.

Thumbwheel 1006 includes an internal set of threads 1038 sized to engage threaded shaft 1028. Ridges 1040 ring the circumference of thumbwheel 1006 to provide a non-slip surface.

Depth adjuster 770 is rigidly connected to base 702 by screw 709 through hole 714 and the hole in stanchion 1018. Stanchion 1018 is fitted to recess 718 while stanchion 1022 is fitted to hole 715.

In use, undermount drawer slide clip mounting apparatus 700 is affixed to the underside of the drawer, adjacent drawer face 104, with screws through holes 712 and 713. To releasably clip the drawer to drawer rail 106, lever arm 728 is pivoted about pivot hole 736 by applying a force to trigger 739 in a direction generally parallel to the bottom surface of the drawer towards the drawer slide assembly. Strike 738 projects through gap 775, abuts catch 784 within slot 792, and slides catch 784 within channel 774 against the bias of spring 790. Tab 114 of drawer rail 106 is slidingly inserted into slot 783 and the front end of drawer rail 106 slides over ramp 758 on height adjuster 752. Trigger 739 is released allowing notch 786 to pass through slot 115 and under shoe 112. Angled edge 787 assists in the alignment of notch 786 with slot 115.

When the drawer is in a closed position, cabinet rail 110 abuts face 1036 on plunger 1004. The position of plunger 1004, and thus face 1036, determines the depth of the drawer relative to the cabinet carcass. To adjust the depth the drawer closes to relative to the cabinet carcass, plunger 1004 is extended from or retracted within housing 1002. As plunger 1004 extends from housing 1002, the closed position of the drawer relative to the cabinet carcass is extended further out of the cabinet carcass. Rotation of thumbwheel 1006 in a first direction extends plunger 1004 out of housing 1002. Rotation of thumbwheel 1006 in a second direction retreats plunger 1004 back into housing 1002 resulting in a closed position where the position of the drawer relative to the cabinet carcass is retracted, or less extended out of the cabinet carcass. Once the desired depth is achieved, rotation of thumbwheel 1006 is ceased. It is understood that different drawer closing depths can be achieved through the length of threaded shaft 1028.

Figure 11:
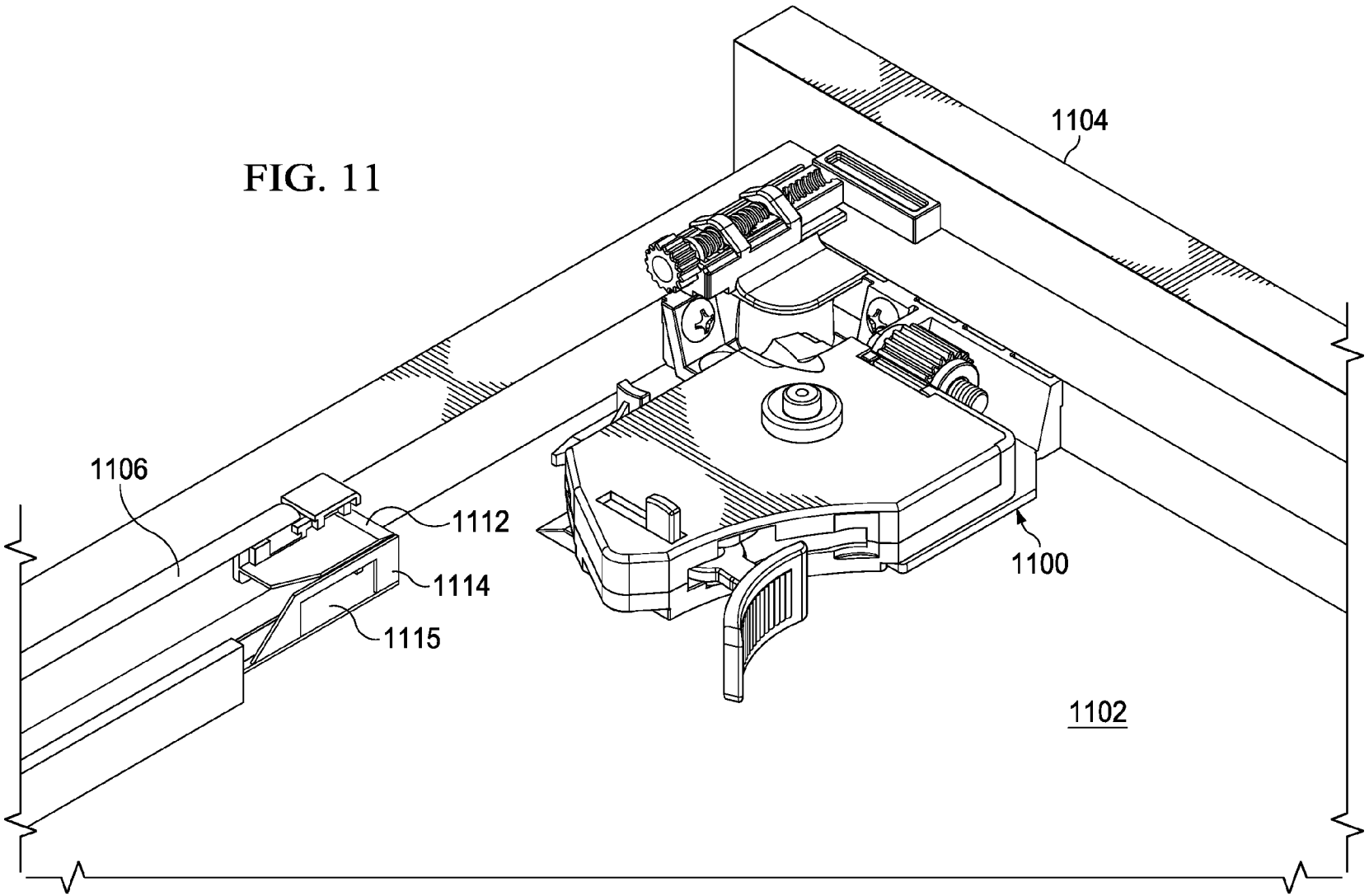
FIG. 11 is an isometric view of a preferred embodiment attached to the underside of a drawer.
Figure 12:
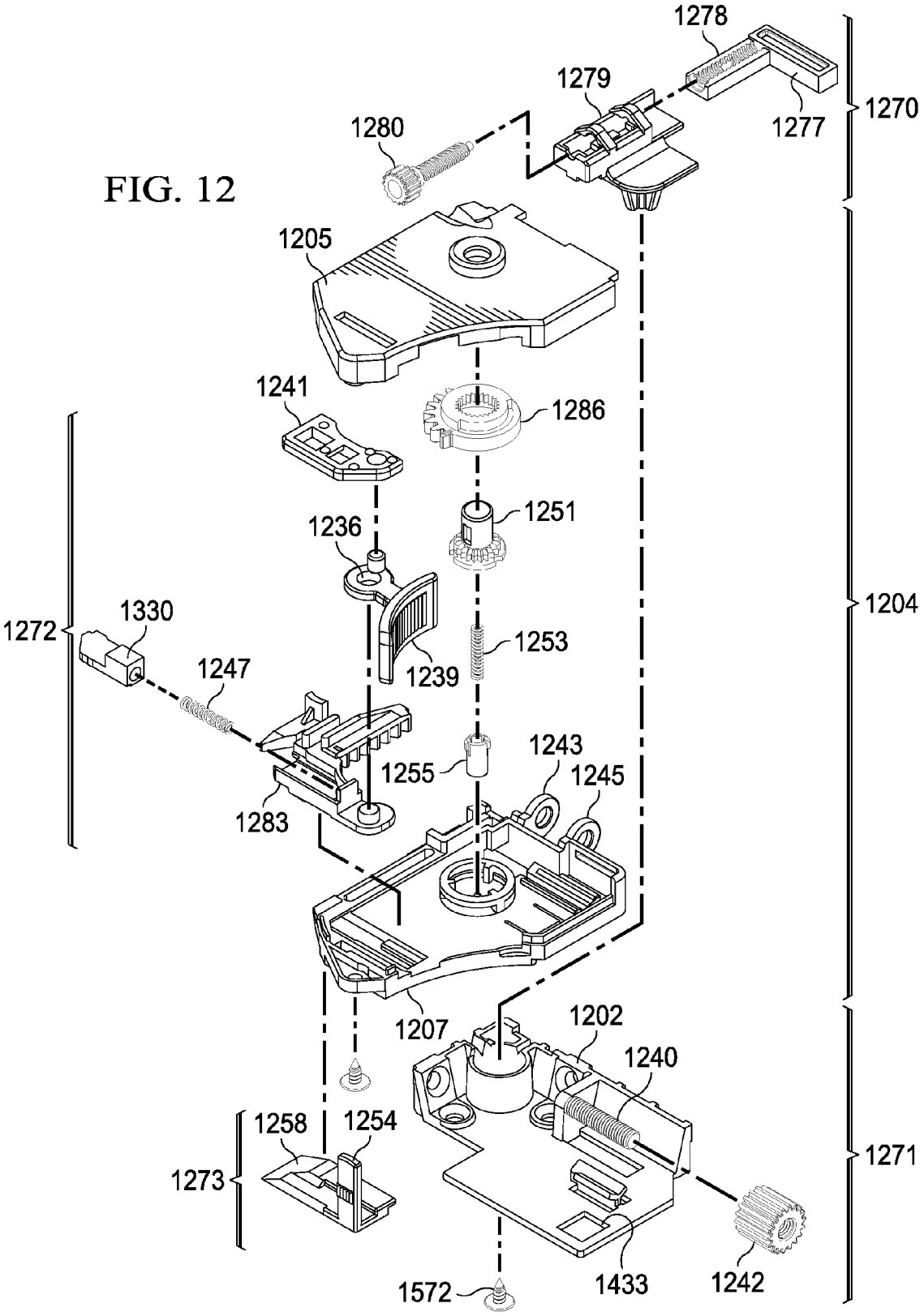
FIG. 12 is an exploded isometric view of a preferred embodiment.
Figure 13:
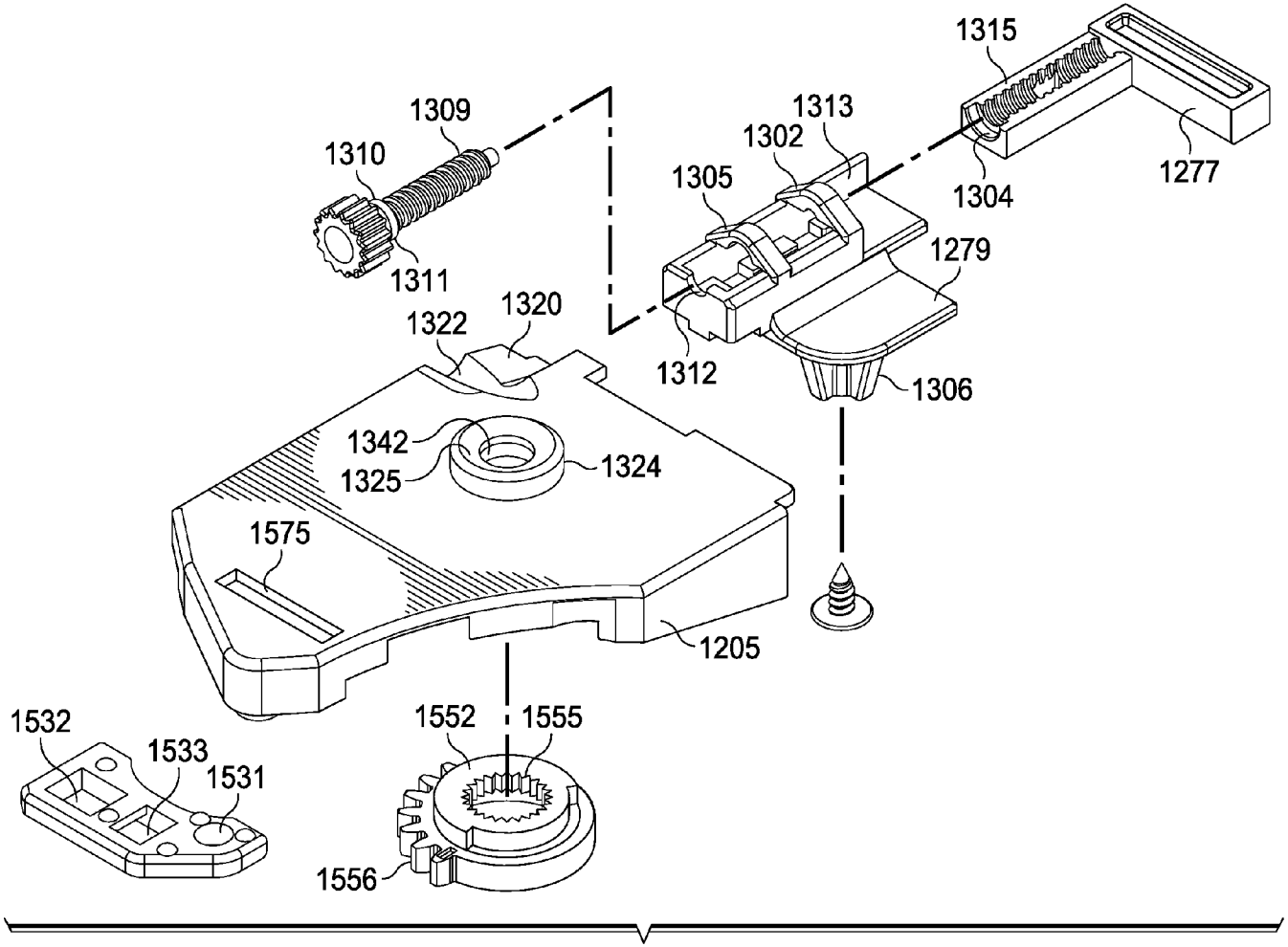
FIG. 13 is an exploded isometric view of a preferred embodiment.
Figure 14:
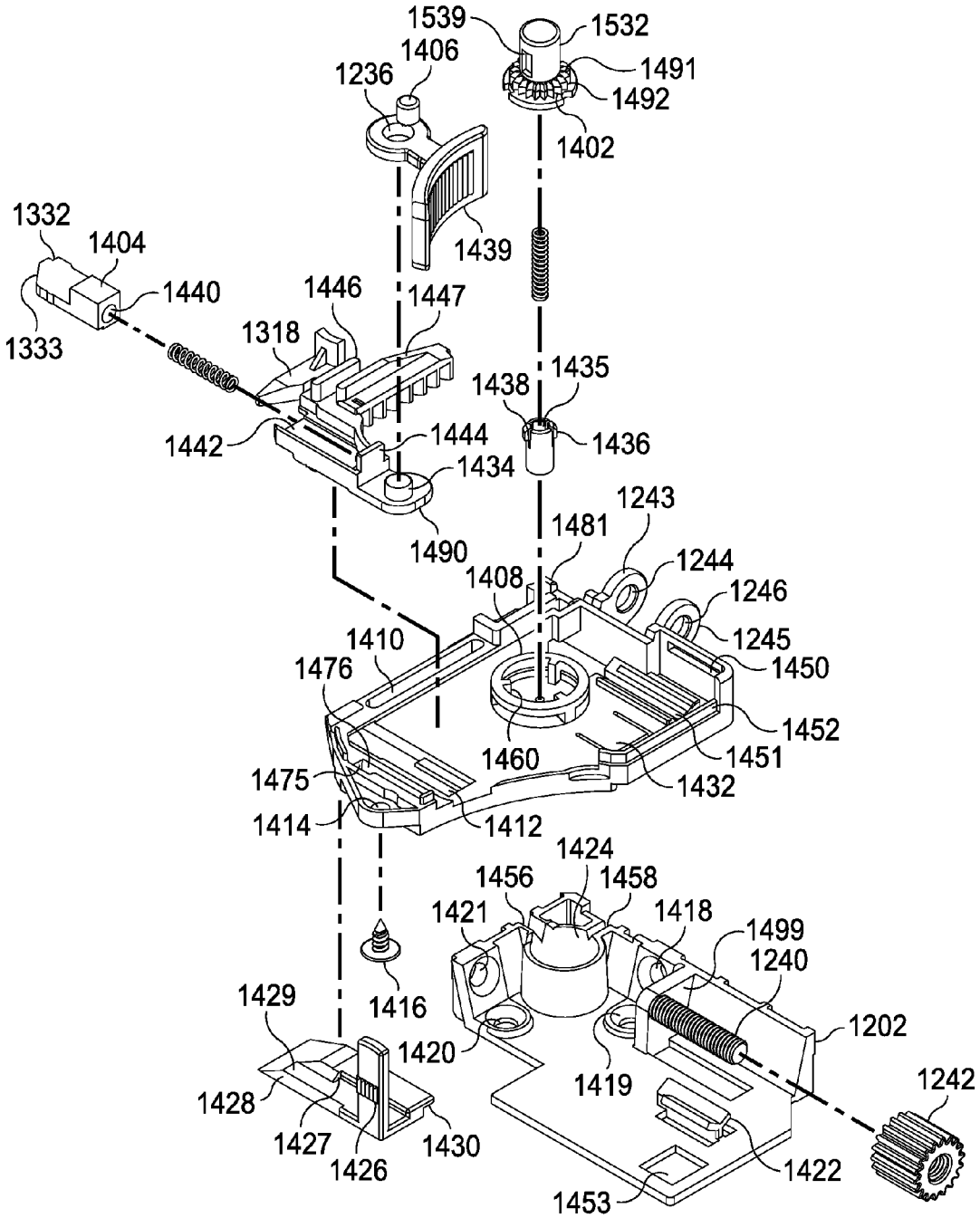
FIG. 14 is an exploded isometric view of a preferred embodiment.
Figure 15:
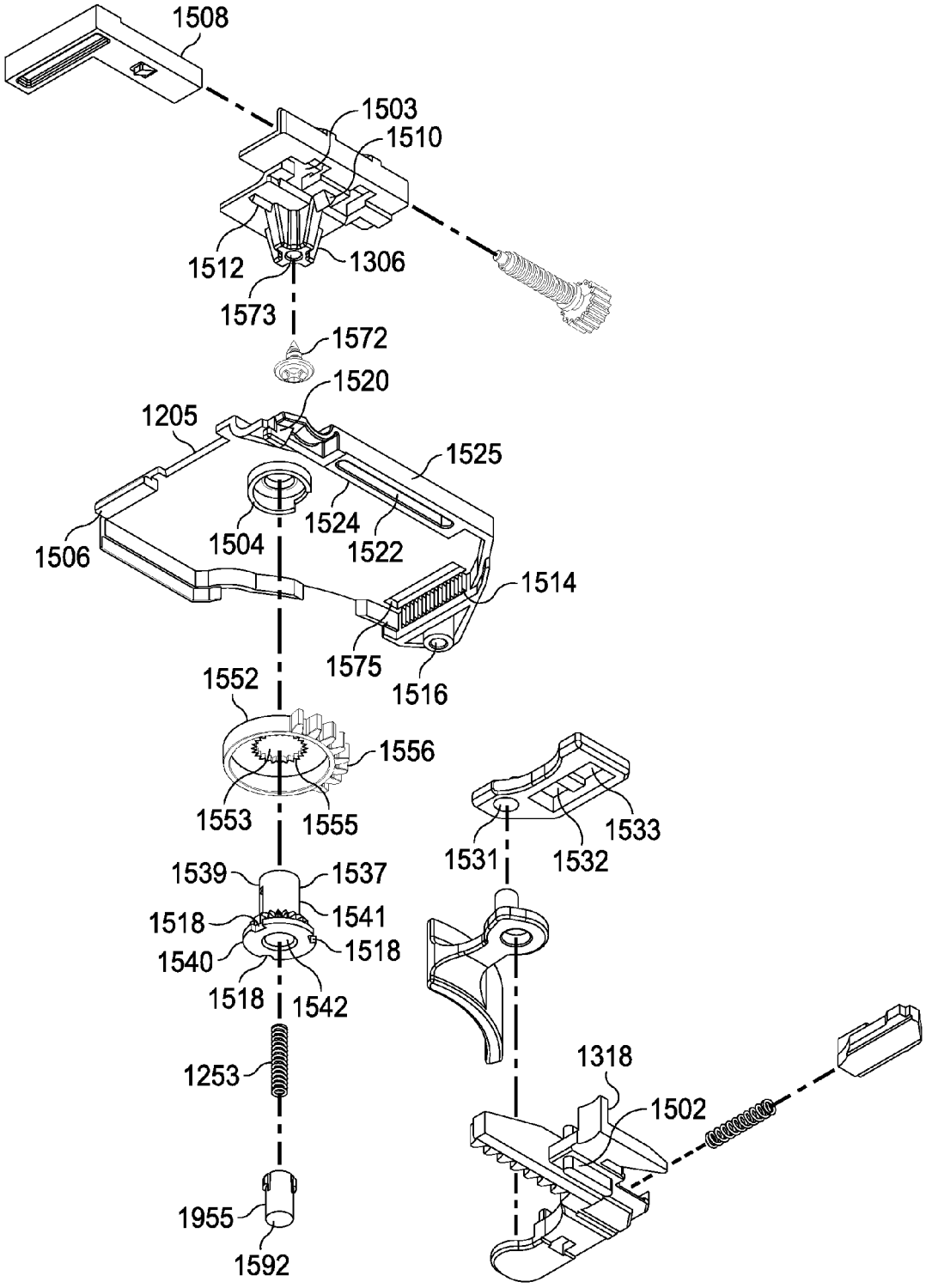
FIG. 15 is an exploded isometric view of a preferred embodiment.
Figure 16:
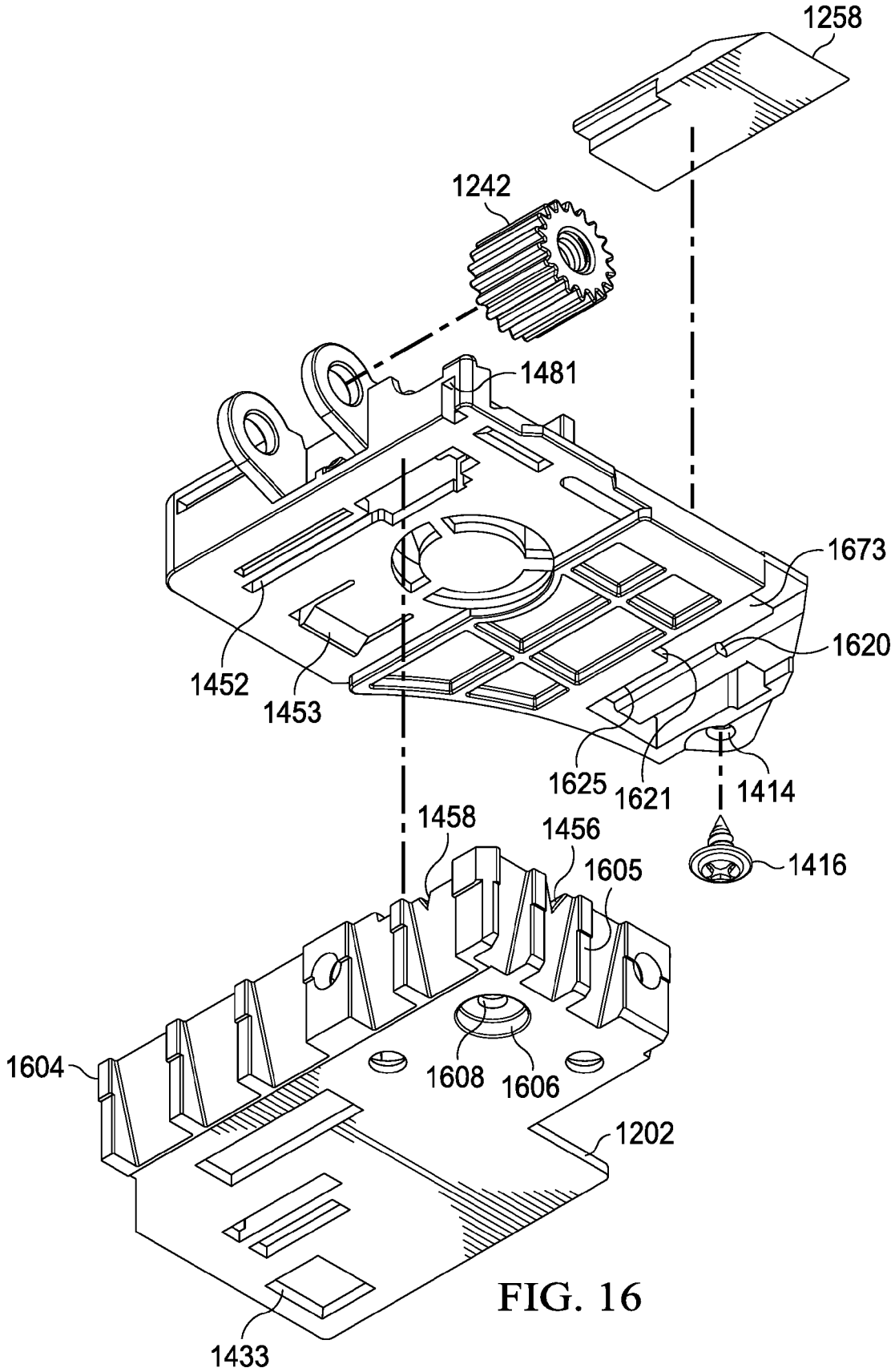
FIG. 16 is an exploded isometric view of a preferred embodiment.

Referring to FIG. 11, an alternate embodiment of the apparatus is described. Undermount drawer slide clip mounting apparatus 1100 is mounted on the underside of drawer 1102 adjacent drawer face 1104. Drawer rail 1106 is aligned with the apparatus. Drawer rail 1106 is mounted to the cabinet carcass with conventional mounting hardware. Drawer rail 1106 includes tab 1114. Drawer rail 1106 is fitted with shoe 1112. Tab 1114 defines slot 1115.

Referring to FIGS. 12-16, undermount drawer slide clip mounting apparatus 1100 is further described.

Undermount drawer slide clip mounting apparatus 1100 comprises depth adjuster 1270, bonnet 1204, lateral adjuster 1271, release mechanism 1272, and vertical adjuster 1273.

Lateral adjuster 1271 is supported by base 1202. Base 1202 is positioned adjacent one corner of drawer 1102 and secured by screws through attachment holes 1418, 1419, 1420, and 1421.

Base 1202 includes spindle 1240, which is threaded and fixed to support wall 1499. Base 1202 further includes lock hole 1433 and "Y" guide stanchion 1422, as will be further described. Base 1202 further includes open support cylinder 1424 and "V" guide seats 1456 and 1458, whose use will be further described. Base 1202 further includes buttress sets 1604 and 1605. The buttress sets provide strength and rigidity to the base and serve to secure it squarely in the corner of drawer 1102.

Base 1202 further includes mounting recess 1606 and mounting hole 1608. Mounting recess 1606 is coaxial with support cylinder 1424. Mounting hole 1608 passes through mounting recess 1606 to the bottom of support cylinder 1424.

Bonnet bottom 1207 includes flanges 1243 and 1245. Flange 1243 includes through hole 1244. Flange 1245 includes through hole 1246. Through hole 1244 and through hole 1246 are of the same diameter and are coaxial.

Bonnet bottom 1207 further includes latch slot 1450. Latch slot 1450 comprises a horizontal indention. Bonnet bottom 1207 further includes "Y" guide 1451. Y guide 1451 further comprises a V shaped trench spanning approximately half the body width of bonnet bottom 1207. Central to Y guide 1451 is Y guide slot 1452, as will be further described. Bonnet bottom 1207 further includes lock plate 1432. Lock plate 1432 is formed as a flexible lever integrally formed with bonnet bottom 1207. Lock plate 1432 further includes lock plate catch 1453 on its bottom side. Lock plate catch 1453 extends below the bottom surface of bonnet bottom 1207. Lock plate catch 1453 engages lock hole 1433 and prevents excess movement of bonnet bottom 1207 with respect to base 1202.

Lateral adjuster 1271 comprises knob 1242 is positioned between flange 1243 and 1245 and threaded onto spindle 1240 of base 1202. Y guide stanchion 1422 is positioned within Y guide slot 1452 adjacent Y guide 1451. Knob 1242 is threaded onto spindle 1240 retaining its position between flange 1243 and 1245. Bonnet bottom 1207 is positioned on base 1202 so as to effect lateral movement between the two components when the knob is turned. Base 1202 is constrained to lateral movement with respect to bonnet 1204 by the action of Y guide stanchion 1422 in Y guide slot 1452.

Bonnet bottom 1207 further comprises integrally formed cylindrical riser 1408. Cylindrical riser 1408 further comprises three riser guides 1460. In a preferred embodiment, the riser guides each are rectangular in shape and are interposed at 120° angles about the inside surface of cylindrical riser 1408. In another preferred embodiment, one of the riser guides includes a different cross section than the others, so as to allow only a single position of release button 1251, as will be further described.

Bonnet bottom 1207 further comprises guide slot 1412 and guide slot 1410, as will be further described. The bottom surface of bonnet bottom 1207 further includes vertical adjuster 1273 adjacent mounting hole 1414. Vertical adjuster 1273 includes lateral guide ledge 1620. Vertical adjuster 1273 further includes vertical adjuster guide stop 1621 arranged adjacent guide ledge 1620.

Vertical adjuster 1273 includes ramp 1258. Ramp 1258 is generally fitted within vertical adjuster recess 1673 of base 1202, to effect lateral movement from a stowed position in vertical adjuster recess 1673 to an extended position laterally out of vertical adjuster recess 1673. When assembled, ramp 1458 is forced between the drawer rail and the drawer to effect a vertical adjustment.

Ramp 1258 includes generally vertical extension 1254. Extension 1254 includes serrated teeth 1426 arranged laterally across the extension. Ramp 1258 further includes guide slot 1428 and guide slot 1430. Ramp 1258 further includes lateral guide ledge receiver 1427 and lateral guide stop receiver 1429.

Ramp 1258 is positioned in vertical adjuster recess 1673, such that extension 1254 extends through extension access slot 1475 and extension guide slot 1575. Serrated teeth 1426 are brought into engagement with serrated teeth 1514, such that guide slot 1430 fits over guide ledge 1625. Likewise, guide slot 1428 is positioned adjacent guide ledge 1620.

When assembled, ramp 1258 is positioned within vertical adjuster recess 1673 such that guide slot 1428 is adjacent guide ledge 1620 and such that guide slot 1430 is adjacent guide ledge 1625. Extension 1254 extends through extension access slot 1475 and extension guide slot 1575. In the stowed position, vertical adjuster guide stop 1621 is held adjacent lateral guide stop receiver 1429 by engagement of serrated teeth 1426 with serrated teeth 1514. In the extended position, extension 1254 is held adjacent distal surface 1476 of extension access slot 1475, by engagement of serrated teeth 1426 with serrated teeth 1514, of the bonnet top.

Bonnet top 1205 includes centrally located hole 1342 surrounded by safety collar 1324. In a preferred embodiment, safety collar 1324 includes hemispherical indention 1325. Bonnet top 1205 includes extension guide slot 1575 and access indentions 1320 and 1322. In a preferred embodiment, access indention 1322 is coaxial with attachment hole 1421 and access indention 1320 is coaxial with attachment hole 1418. The access indentions facilitate access to the attachment holes with a screwdriver.

Bonnet top 1205 further includes latch surface 1506 and latch 1520 at its proximal end. Bonnet top 1205 further includes serrated teeth 1514 adjacent to extension guide slot 1575. Mounting hole 1516 is vertically oriented and positioned adjacent serrated teeth 1514 at the distal end of the bonnet top. Bonnet top 1205 further includes guide slot 1522 positioned between edge 1525 and guide slot wall 1524. Pressure collar 1504 is semi-cylindrical and is integrally formed with bonnet top 1205. Pressure collar 1504 is coaxial with safety collar 1324 and hemispherical indention 1325. The pressure collar is used to hold collar 1286 against cylindrical riser 1408.

Bonnet top 1205 is designed to securely and releasably connect to bonnet bottom 1207. When assembled, latch 1520 resides within catch 1481. Likewise, latch surface 1506 resides within latch slot 1450. Screw 1416 is threaded through mounting hole 1414 of bonnet bottom 1207 and into mounting hole 1516.

Release mechanism 1272 is positioned and held in place between bonnet top 1205 and bonnet bottom 1207, when assembled. Release mechanism 1272 includes rack positioner 1283 slidingly engaged with bonnet top 1205 and bonnet bottom 1207. Rack positioner 1283 includes rack guide post 1446, positioned parallel to rack guide wall 1447. Rack guide post 1446 is constrained to move within guide slot 1522. Rack guide wall 1447 is positioned to slide linearly along guide slot wall 1524.

Placed directly below rack guide post 1446 is rack guide post 1502. Rack guide post 1502 is constrained to move within guide slot 1410 of bonnet bottom 1207. Through cooperation of rack guide post 1446 constrained within guide slot 1522 and rack guide post 1502 constrained within guide slot 1410, rack positioner 1283 is constrained to move in a strictly linear path along the side of bonnet bottom 1207 and bonnet top 1205, in a depth direction, aligned with drawer rail 1106 and a side of drawer 1102.

Rack positioner 1283 further includes guide slot 1442 positioned adjacent transfer plate guide post 1444. Rack positioner 1283 further includes support arm 1490 integrally formed with transfer plate guide post 1444. Support arm 1490 includes pivot support 1434. Catch 1330 is designed to fit within and be constrained to horizontal linear movement by guide slot 1442. Catch 1330 includes angled edge 1333 and notch 1332. Angled edge 1333 and notch 1332 are designed to engage slot 1115 and tab 1114 of drawer rail 1106. Catch 1330 includes retaining hole 1440. Spring 1247 is resident within retaining hole 1440 and rests on the transfer plate guide post such that it biases the catch away from the transfer plate guide post.

Trigger 1439 includes pivot hole 1236. Pivot hole 1236 is positioned to fit over pivot support 1434 and provides rotational movement about the pivot support for trigger 1439.

Release mechanism 1272 further includes transfer plate 1241. Transfer plate 1241 further includes pivot hole 1531, guide dog retainer 1532, and guide post retainer 1533. Transfer stanchion 1406 of trigger 1439 resides within pivot hole 1531. Guide dog 1404 of catch 1330 resides within guide dog retainer 1532. Transfer plate guide post 1444 resides within guide post retainer 1533. The transfer plate is constrained by the transfer plate guide post to linear movement between a stowed position and an extended position. The bias of spring 1247 retains the catch in the extended position until retracted by pressure on trigger 1239, as will be further described.

Rack positioner 1283 further includes arm 1318. Arm 1318 is designed to engage drawer rail 1106 adjacent tab 1114 and retain undermount drawer slide clip mounting apparatus 1100 adjacent shoe 1112.

Release mechanism 1272 further comprises collar 1286. Collar 1286 is generally cylindrical and includes top surface 1552 and centrally disposed hole 1553. Hole 1553 includes interior teeth 1555. In a preferred embodiment, interior teeth 1555 comprise radial inward facing triangular teeth. Collar 1286 further includes outward facing pinion teeth 1556 integrally formed with an outside surface of the cylinder. In a preferred embodiment, the pinion teeth further comprise radial outward facing gear teeth covering approximately 120° of the exterior of the collar.

Figure 17A:
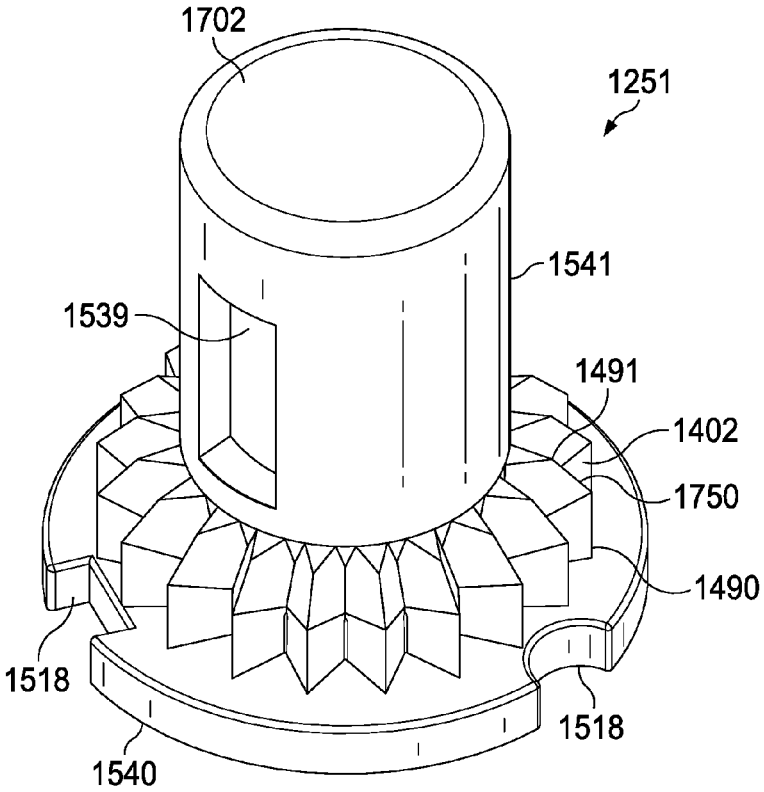
FIG. 17A is an isometric view of a component detail of a preferred embodiment.
Figure 17B:
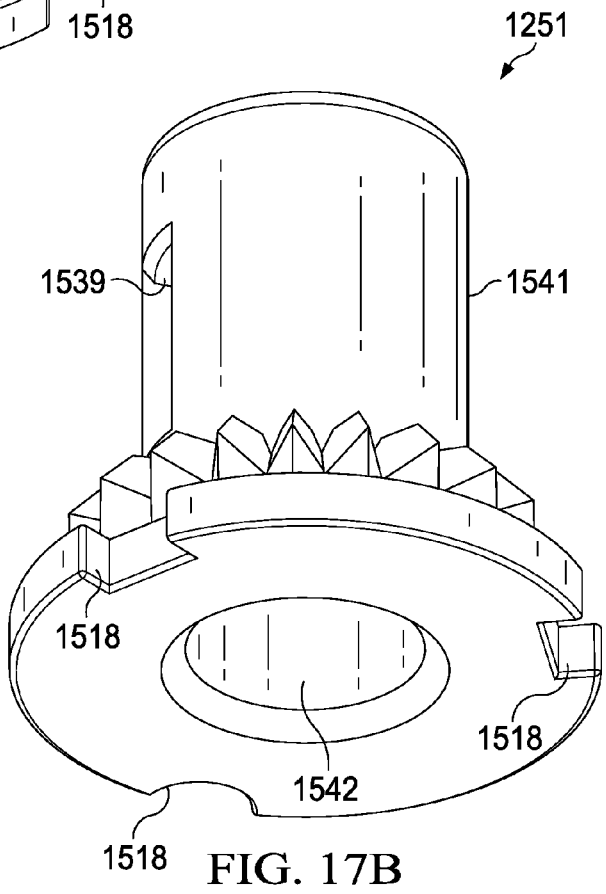
FIG. 17B is an isometric view of a component detail of a preferred embodiment.

Referring also to FIGS. 17A and 17B, release button 1251 includes base flange 1540 integrally formed with cylindrical button body 1541. Base flange 1540 includes three riser guide slots 1518, which are radially opposed at 120°. Button body 1541 includes coaxial hole 1542. Lock slots 1537 and 1539 are horizontal through holes formed in the exterior surface of button body 1541. In a preferred embodiment, the lock slots are diametrically opposed. Integrally formed with the top surface 1702 of base flange 1540 and button body 1541 are graduated engagement teeth 1402. Graduated engagement teeth 1402 include a lower tooth radius 1492 and an upper tooth radius 1491. In a preferred embodiment, the upper tooth radius is approximately 20% less than the lower tooth radius. Between lower tooth radius 1492 and upper tooth radius 1491 is transition radius 1750. Transition radius 1750 forms a graduated tooth cross section for each tooth which is designed to facilitate engagement of the engagement teeth with interior teeth of collar 1286, as will be further described.

Alignment sleeve 1255 is cylindrical and includes flexible lock tabs 1438 and 1436. In a preferred embodiment, the lock tabs are diametrically opposed. Alignment sleeve 1255 further includes base 1592 and hole 1435.

When assembled, alignment sleeve 1255 resides in hole 1542 of the release button where lock tab 1438 engages lock slot 1539 and lock tab 1436 engages lock slot 1537. Spring 1253 fits inside hole 1542 and hole 1435 and biases release button 1251 against the base of alignment sleeve 1255 and allows compression of alignment sleeve 1255 into the interior of release button 1251. Riser guide slots 1518 engage riser guides 1460 within cylindrical riser 1408. Collar 1286 is positioned over release button 1251 such that interior teeth 1555 engage graduated engagement teeth 1402. Collar 1286, is forced downward onto release button 1251 by pressure collar 1504 of bonnet top 1205.

Pivot hole 1236 of trigger 1439 is positioned on pivot support 1434 on support arm 1490 of rack positioner 1283. Catch 1330 is positioned in guide slot 1442. Spring 1247 is positioned in retaining hole 1440 and biases catch 1330 against transfer plate guide post 1444. Rack guide post 1502 is positioned within guide slot 1410 of bonnet bottom 1207. Rack guide post 1446 is positioned in guide slot 1522. Rack guide wall 1447 is held adjacent guide slot wall 1524 and constrains movement of rack positioner 1283 linearly within assembled bonnet top 1205 and bonnet bottom 1207.

Depth adjuster 1270, comprises thumbscrew 1280, carriage 1279, and plunger 1278. Carriage 1279 further comprises arches 1302 and 1305. Plunger 1278 includes guide arm 1315. Guide arm 1315 includes half threaded trench 1304 and engagement surface 1277. When assembled, thumbscrew 1280 is threaded into arches 1302 and 1305. Angular slot 1311 is positioned within cutout 1312 adjacent thrust collar 1310. Guide arm 1315 is positioned against guide wall 1313. Half-threaded trench 1304 is threaded onto threads 1309 of thumbscrew 1280. Travel limit stanchion 1508 fits within travel stop 1503 and prevents excess movement of plunger 1278 with respect to carriage 1279. Support stanchion 1306 is positioned within support cylinder 1424 where V guide pin 1510 is positioned within V guide seat 1456 and V guide pin 1512 is positioned within V guide seat 1458. Screw 1572 is threaded into mounting hole 1608 and mounting recess 1606 and threaded into hole 1573 of support stanchion 1306.

In use, undermount drawer slide clip mounting apparatus 1100 is positioned in a corner of drawer 1102 and secured by wood screws through holes 1418, 1419, 1420, and 1421. Trigger 1439 is depressed and rotates about pivot hole 1236. Resulting movement of transfer stanchion 1406, resident in pivot hole 1531, causes transfer plate 1241 to slide linearly, with respect to transfer plate guide post, compressing spring 1247 and thereby moving guide dog 1404 and retracting catch 1330 within bonnet 1204.

Drawer rail 1106 is advanced thereby engaging tab 1114 with arm 1318, adjacent catch 1330. Trigger 1239 is then released, thereby extending angled edge 1333 and notch 1332 into slot 1115.

In order to adjust the connection between tab 1114 and arm 1318, release button 1251 is depressed thereby compressing spring 1253 into alignment sleeve 1255 and disengaging graduated engagement teeth 1402 from interior teeth 1555 of collar 1286. This disengagement allows collar 1286 to freely rotate. Because collar 1286 can freely rotate, rack positioner 1283 is allowed to slide linearly in proximal and distal depth directions constrained by guide slot 1410 and guide slot 1522. Arm 1318 is then manually advanced or retracted in slot 1115 until the desired connection tolerance is achieved. When the desired tolerance is achieved, release button 1251 is released, thereby allowing spring 1253 to move release button upward, thereby engaging graduated engagement teeth 1402 with interior teeth 1555, thus preventing rotation of collar 1286 and preventing linear movement of rack positioner 1283.

In order to laterally adjust the undermount drawer slide clip, knob 1242 is rotated in one direction or the other. Rotation of knob 1242 causes it to move laterally with respect to spindle 1240. Because spindle 1240 is fixed with respect to base 1202, linear movement of knob 1242 forces flanges 1243 and 1245 to also move laterally with respect to base 1202. Movement of flanges 1243 and 1245 consequently moves bonnet bottom laterally, with respect to base 1202 along Y guide slot 1452 constrained by Y guide stanchion 1422. At the limit of travel, lock plate catch 1453 engages lock hole 1433 thereby preventing further linear movement of bonnet bottom 1207 with respect to base 1202. Lateral movement of base 1202 with respect to bonnet bottom 1207 laterally adjusts drawer rail 1106 with respect to drawer face 1104 due to the connection of arm 1318 with tab 1114.

Vertical adjustment of the drawer face with respect to the drawer rail is accomplished by movement of ramp 1258 with respect to bonnet bottom 1207. In practice, extension 1254 is moved laterally within extension guide slot 1575. Movement of extension 1254 causes serrated teeth 1426 to override serrated teeth 1514 thereby extending or retracting ramp 1258 into a position between drawer rail 1106 drawer 1102. Due to the incline of ramp 1258 as it is advanced underneath drawer rail 1106, it forces drawer rail 1106 away from drawer 1102, thereby raising drawer face 1104. When a desired position is reached, extension 1254 is released whereupon serrated teeth 1426 again engage serrated teeth 1514 and prevent further movement of ramp 1258. A reversal of these steps accomplishes lowering the drawer face.

In order to accomplish a depth adjustment, thumb screw 1280 is rotated within carriage 1279. Because angular slot 1311 is constrained within cut out 1312, the rotation of thumb screw 1280 imparts a linear motion to plunger 1278 by engagement of threads 1309 with half thread trench 1304. Engagement surface 1277 of plunger 1278 engages drawer rail 110 (FIG. 6B). Advancing the plunger, proximally, toward the drawer face, results in the drawer rail being allowed to more closely approach the drawer face when the drawer is closed, thereby allowing the drawer to be closer to the cabinet carcass when the drawer is closed. Retracting plunger 1278, distally, away from the drawer face, causes the drawer face to be farther away from the cabinet carcass when the drawer is closed by holding the drawer rail further from the drawer face. To prevent disengagement of the plunger from the carriage at maximum travel, travel limit stanchion 1508 encounters travel stop 1503 impeding further progress.

Figure 18:
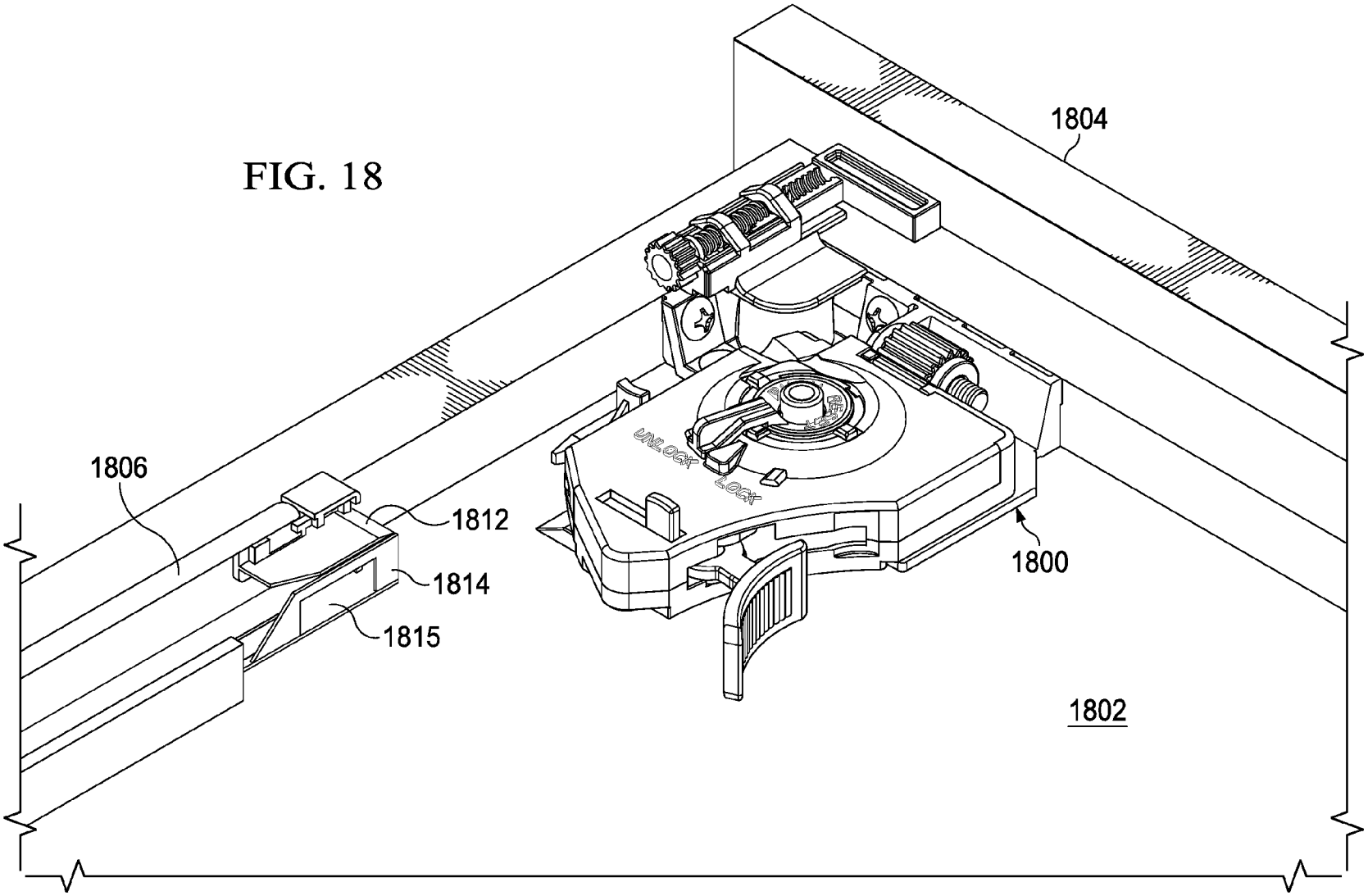
FIG. 18 is an isometric view of a preferred embodiment attached to the underside of a drawer.

Referring then to FIG. 18, an alternate embodiment of the apparatus is described. Undermount drawer slide clip mounting apparatus 1800 is fitted on drawer 1802 and rigidly connected with known fasteners such as wood screws or an epoxy adhesive. The drawer slide clip is positioned adjacent drawer face 1804 and drawer rail 1806.

Figure 19:
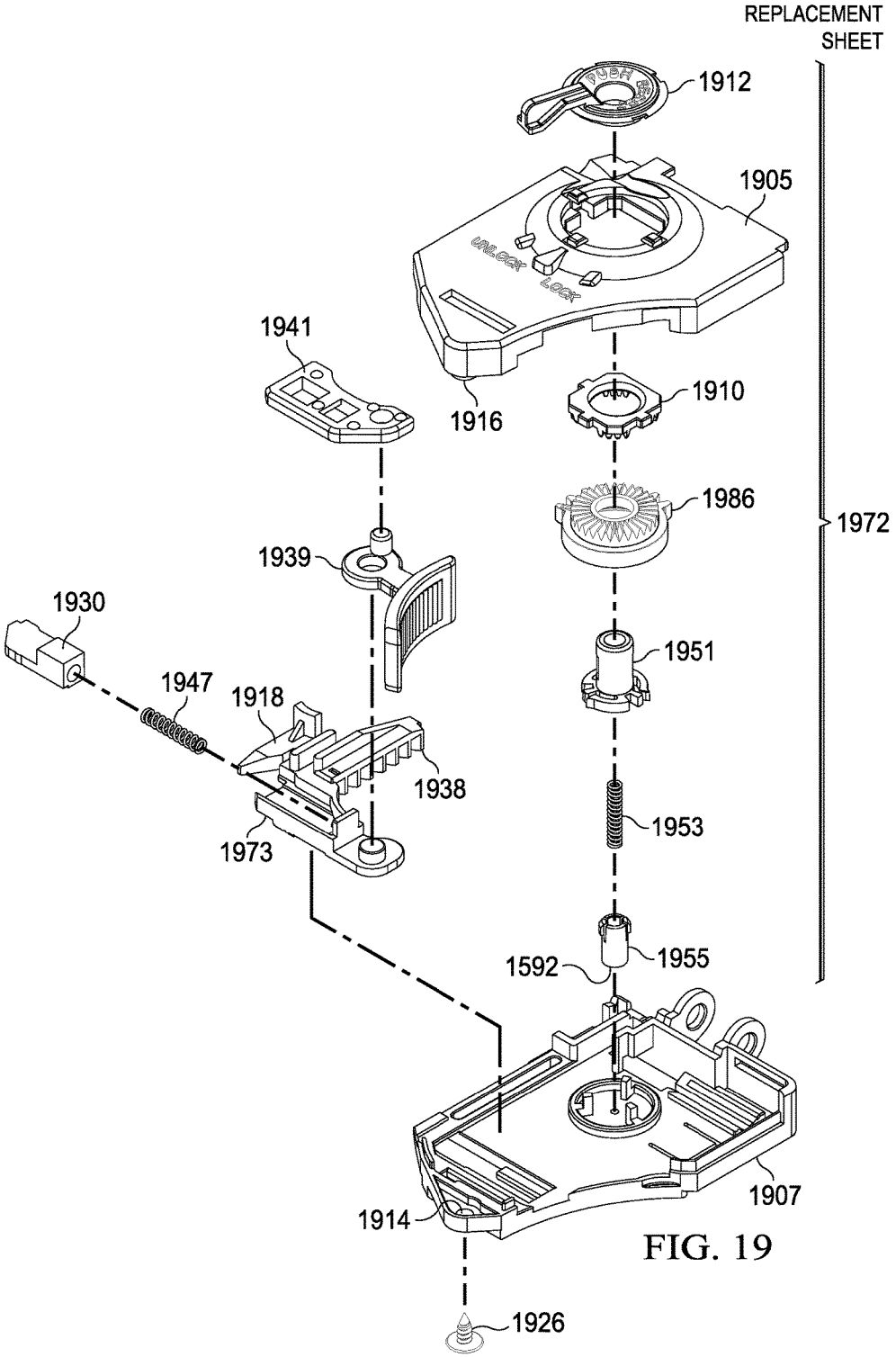
FIG. 19 is an exploded isometric view of a preferred embodiment.
Figure 20:
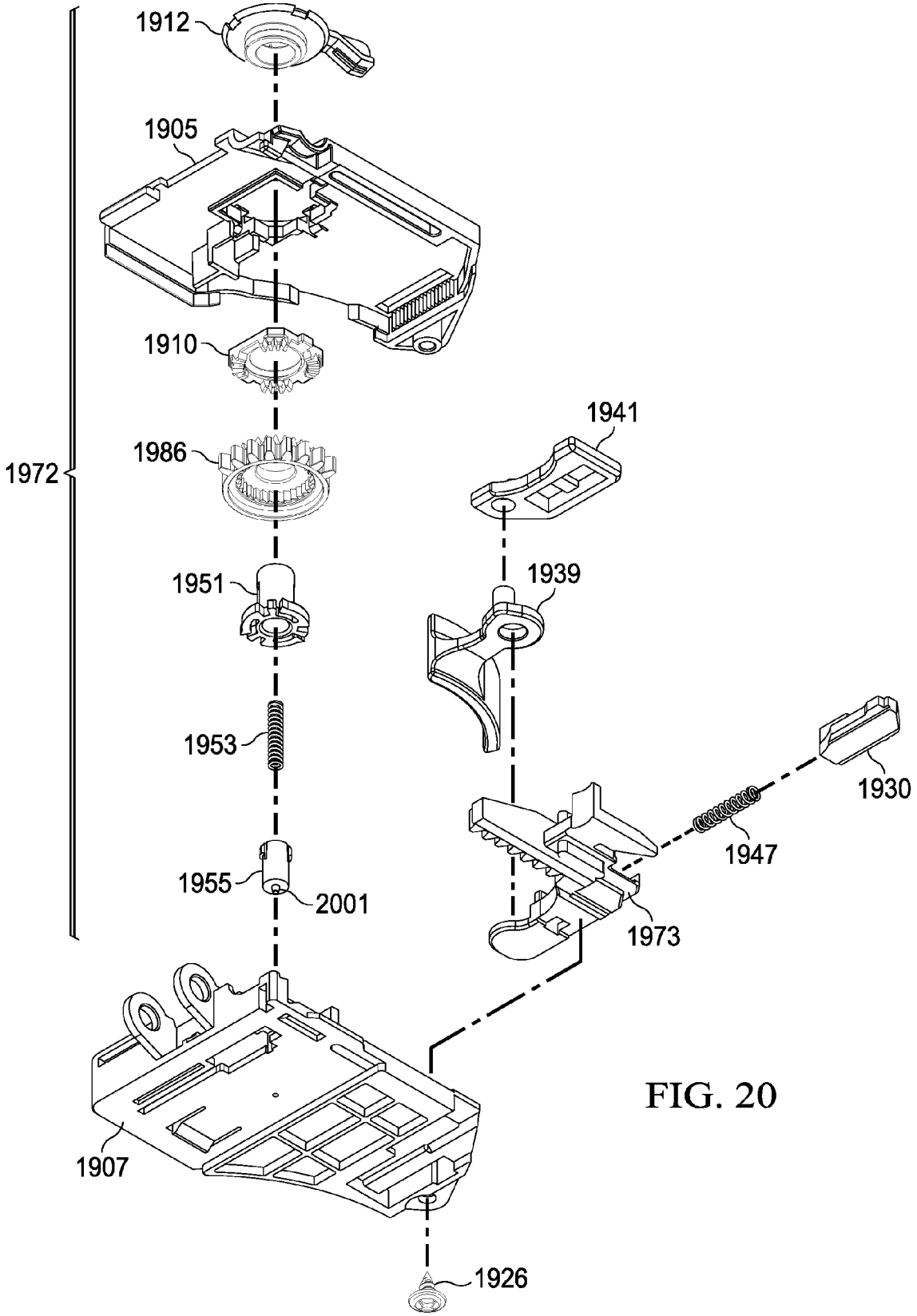
FIG. 20 is an exploded isometric view of a preferred embodiment.

Referring then to FIGS. 19 and 20, undermount drawer slide clip mounting apparatus 1800 includes release mechanism 1972. The other components of undermount drawer slide clip mounting apparatus 1800 are identical to those previously described and a description of them will not be repeated here.

Release mechanism 1972 includes bonnet top 1905 releasably connected to bonnet bottom 1907. Constrained by bonnet top 1905 and bonnet bottom 1907 are locking ring 1910, rack positioner 1973, transfer plate 1941, trigger 1939, spring 1947, catch 1930, and transfer plate 1941. Bonnet top 1905 and bonnet bottom 1907 further constrain pinion collar 1986, release button 1951, spring 1953, and alignment sleeve 1955. Bonnet top 1905 and bonnet bottom 1907 are releasably connected using screw 1926 through holes 1914 and 1916.

Figure 21A:
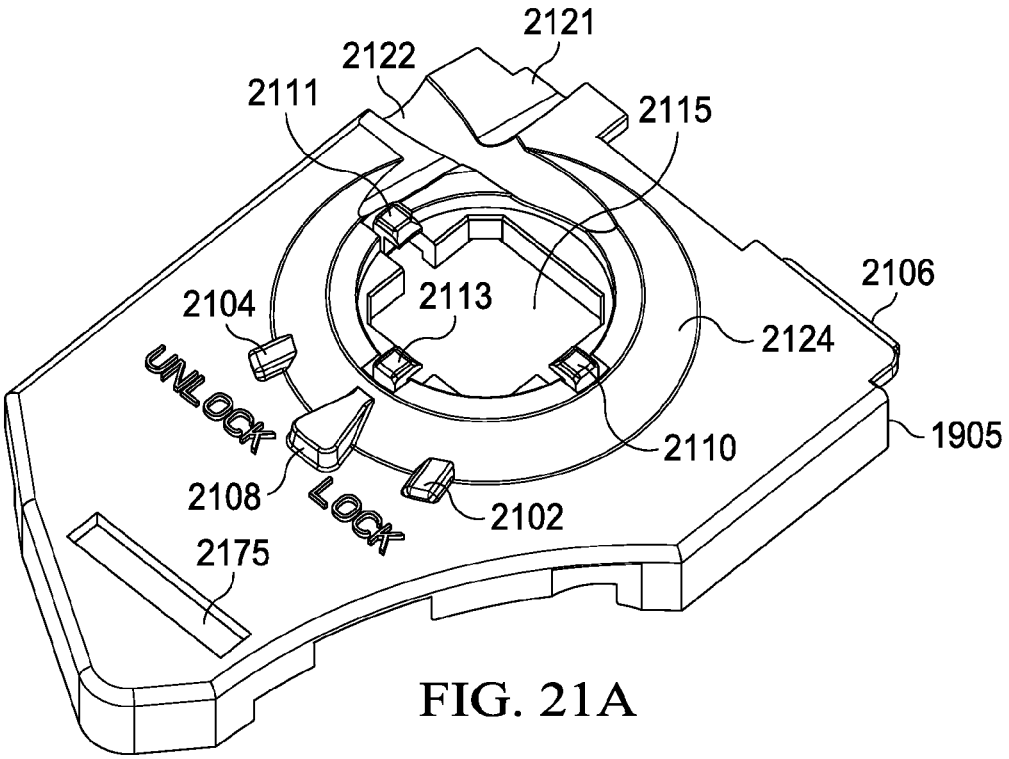
FIG. 21A is an exploded isometric view of a preferred embodiment.
Figure 21B:
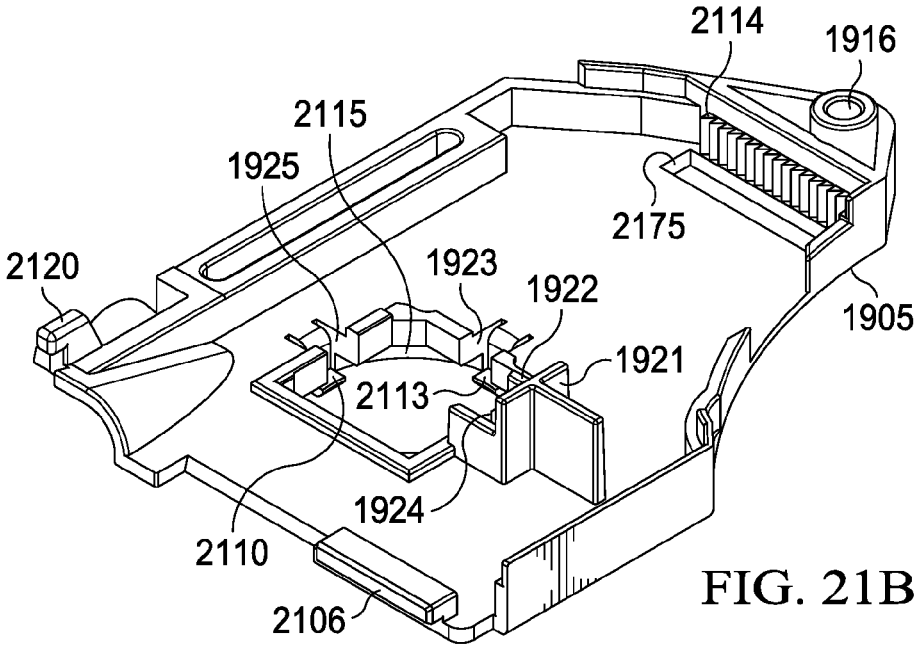
FIG. 21B is an exploded isometric view of a preferred embodiment.

Referring then to FIGS. 21A and 21B, the details of bonnet top 1905 are described.

The upper side of bonnet top 1905 includes safety collar 2124. Safety collar 2124 is frustoconical and includes raised unlock positioner 2104, lock positioner 2102, and lock lever stop 2108. Unlock positioner 2104, lock positioner 2102, and lock lever stop 2108 all are integrally formed with bonnet top 1905. Bonnet top 1905 also includes access indentions 2121 and 2122. Latch surface 2106 is integrally formed with bonnet top 1905 at is proximal end.

Bonnet top 1905 further includes catch 2120 adjacent access indentions 2121 and 2122. Bonnet top 1905 includes square retaining hole 2115 adjacent latch arms 2110, 2111, and 2113. Latch arms 2110, 2111, and 2113 are integrally formed with bonnet top 1905 and can be resiliently deformed to accommodate locking ring 1910, as will be further described. Adjacent retaining hole 2115 are orientation slots 1923, 1924, and 1925.

Bonnet top 1905 includes serrated ratchet rack 2114 and extension access slot 2175.

At its distal end, bonnet top 1905 further comprises positioning shelf 1921 affixed to its inside surface. Positioning shelf 1921 includes retaining ledge 1922.

Figure 22A:
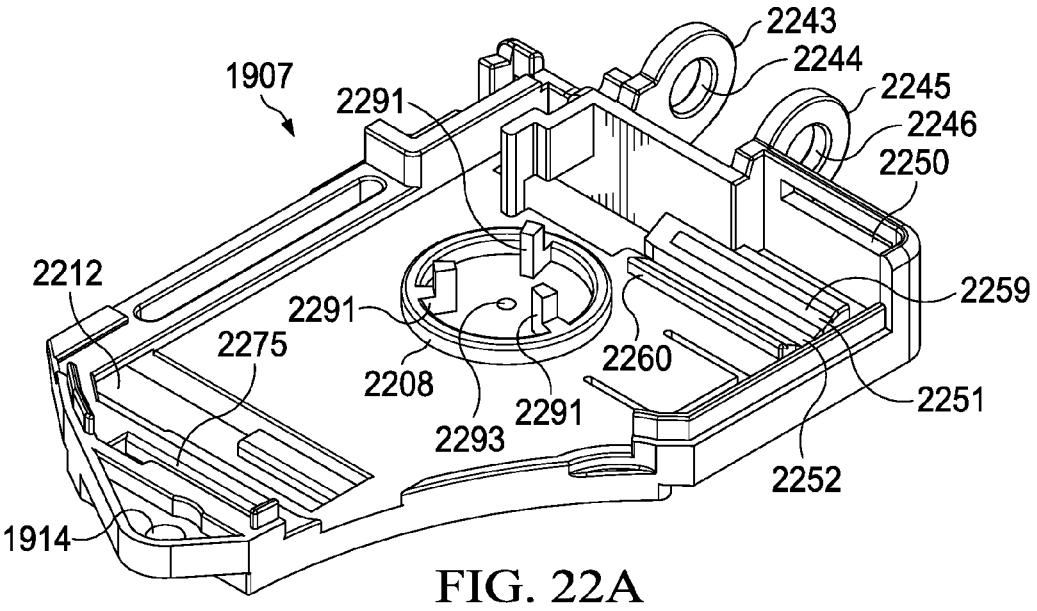
FIG. 22A is an exploded isometric view of a preferred embodiment.
Figure 22B:
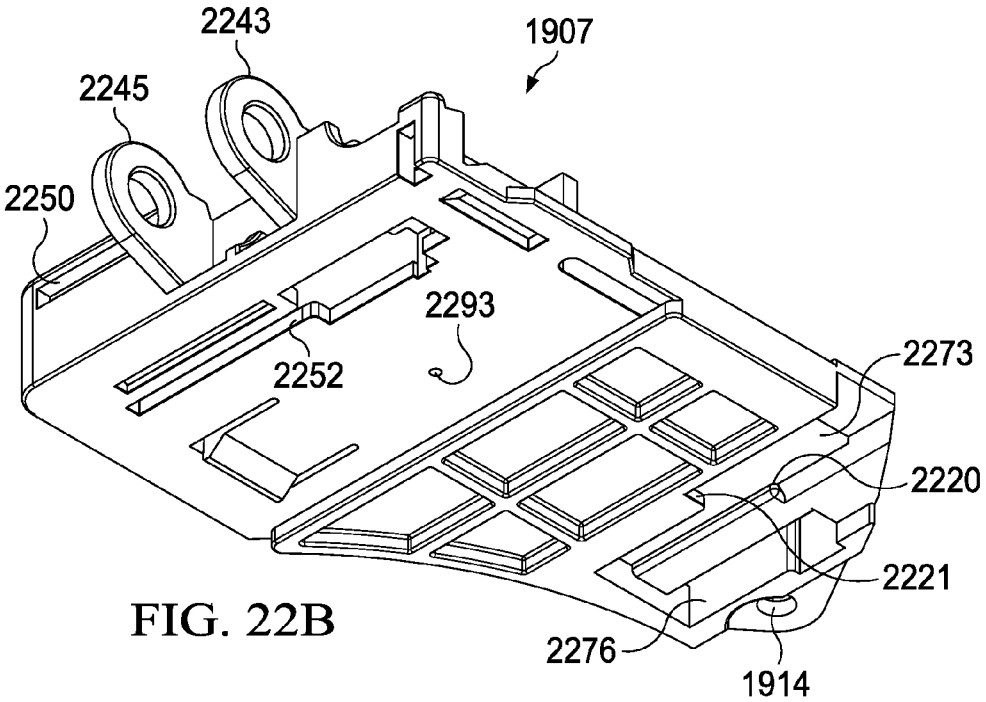
FIG. 22B is an exploded isometric view of a preferred embodiment.

Referring then to FIGS. 22A and 22B, bonnet bottom 1907 will be described. Bonnet bottom 1907 includes flanges 2243 and 2245. Flange 2243 is cylindrical and includes hole 2244. Flange 2245 is cylindrical and includes hole 2246. Hole 2244 and hole 2246 are of the same diameter and are coaxial. Flange 2243 and flange 2245 are, in a preferred embodiment, integrally formed with bonnet bottom 1907. The flanges receive a spindle, as previously described. Bonnet bottom 1907 further includes latch slot 2250. Latch slot 2250 is laterally disposed in the proximal end of bonnet bottom 1907.

Bonnet bottom 1907 further includes Y guide 2251. Y guide 2251 includes angle support 2259 and angle support 2260. Angle support 2259 and angle support 2260 form opposite 45° angled ridges adjacent to Y guide slot 2252, and form a sliding lateral support for a Y guide stanchion, as previously described.

Bonnet bottom 1907 further comprises cylindrical riser 2208. Cylindrical riser 2208 further comprises three positioning stanchions 2291. In a preferred embodiment, the positioning stanchions are opposing and formed at 120° angles. The cylindrical riser and positioning stanchions are integrally formed with bonnet bottom 1907. Center pin hole 2293 is formed in bonnet bottom 1907 at the center of cylindrical riser 2208.

Bonnet bottom 1907 further comprises guide slot 2212 and extension access slot 2275 at its distal end. The distal end of bonnet bottom 1907 further comprises vertical adjuster recess 2273, vertical adjuster guide stop 2221, guide ledge 2220, and distal surface 2276. Guide slot 2212, extension access slot 2275, vertical adjuster recess 2273, guide ledge 2220, vertical adjuster guide stop 2221, and distal surface 2276 position in and guide a ramp for vertical adjustment, as previously described.

Figure 23A:
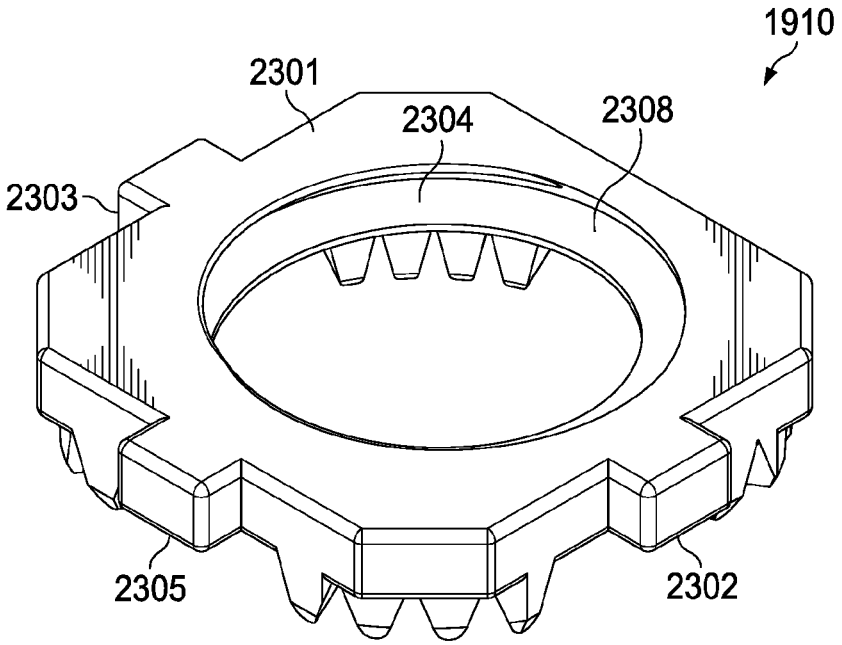
FIG. 23A is an isometric view of a component of a preferred embodiment.
Figure 23B:
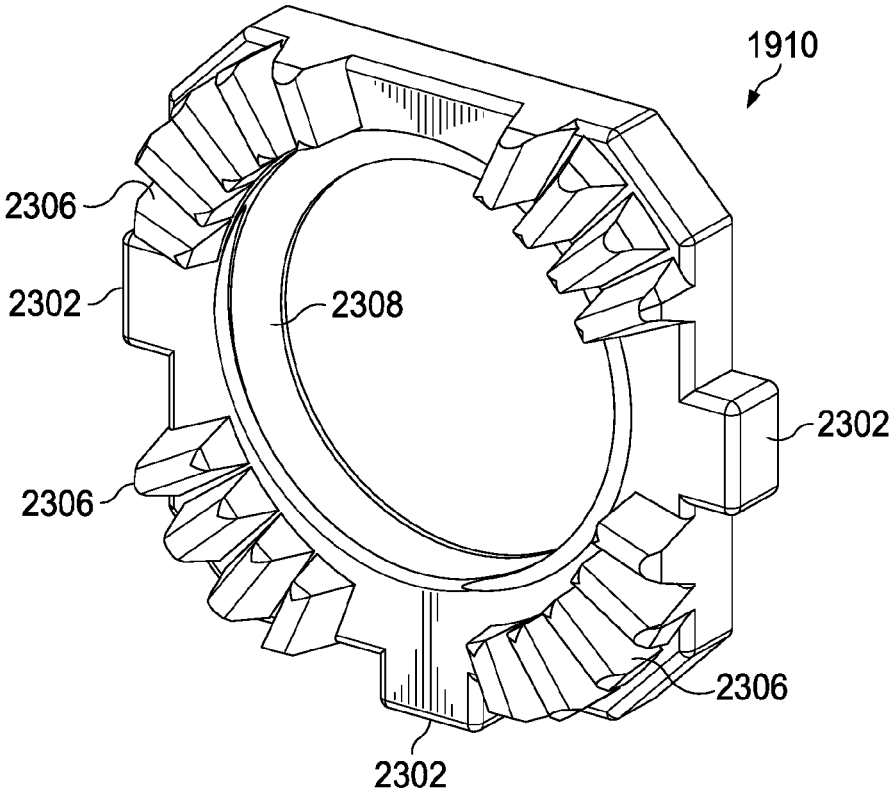
FIG. 23B is an isometric view of a component of a preferred embodiment.

Referring then to FIGS. 23A and 23B, locking ring 1910 will be further described. Locking ring 1910 includes locking ring body 2301. Locking ring body 2301 includes positioning tabs 2302, 2303, and 2305. Positioning tabs 2302, 2303, and 2305 are positioned on three sides of locking ring body 2301 and are designed to slide within orientation slots 1923, 1924, and 1925, respectively, of bonnet top 1905. The asymmetrical arrangement of the positioning tabs allows placement of the locking ring in only one orientation within square retaining hole 2115 of bonnet top 1905. The positioning tabs allow movement of the locking ring vertically within square retaining hole 2115. Locking ring 1910 further comprises release button access hole 2304 surrounded by thread 2308.

On the bottom surface of locking ring body 2301 are four sets of triangular lock teeth 2306. The lock teeth are formed in a circular pattern at the corners of locking ring body 2301. Triangular lock teeth 2306 are designed to engage pinion collar lock teeth 2432 on pinion collar 1986, as will be further described. Thread 2308 is designed to engage riser thread 2402, as will be further described.

Figure 24A:
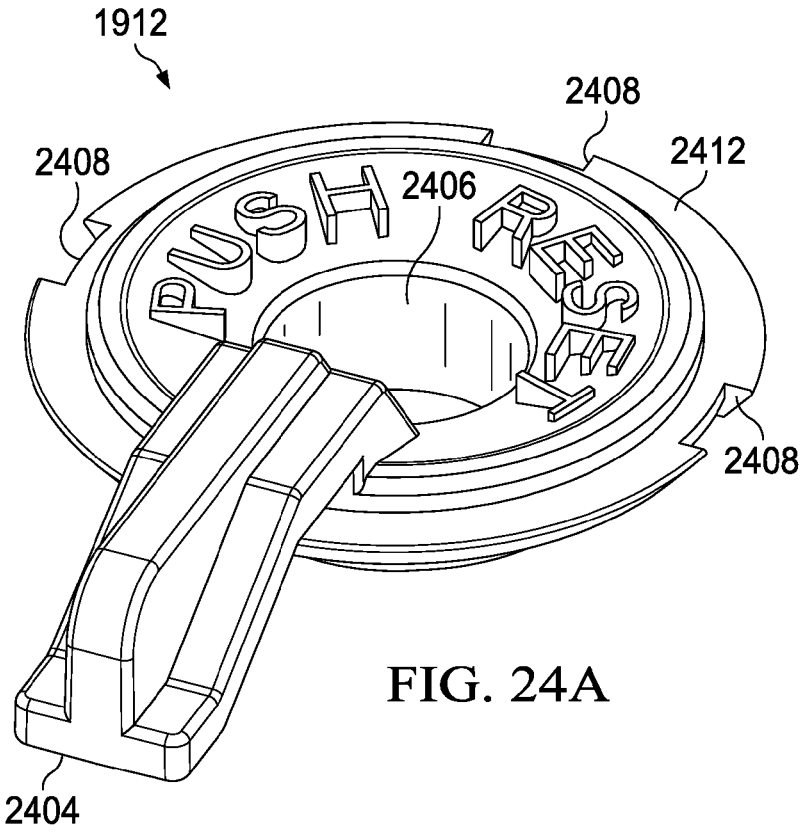
FIG. 24A is an isometric view of a component of a preferred embodiment.
Figure 24B:
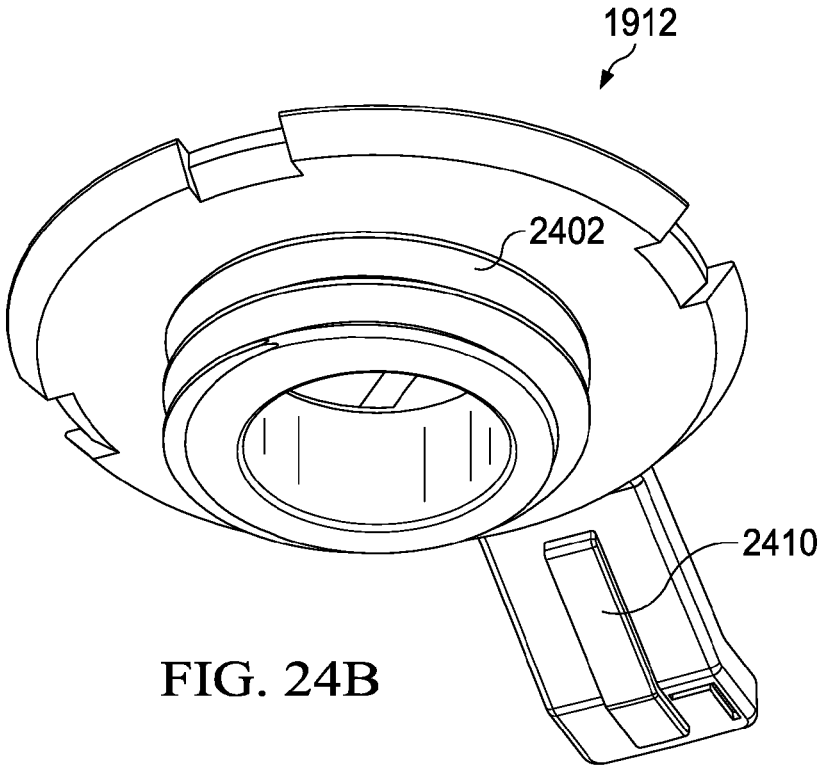
FIG. 24B is an isometric view of a component of a preferred embodiment.

Referring then to FIGS. 24A and 24B, lock lever disc 1912 will be further described. Lock lever disc 1912 includes lock lever body 2412. Lock lever body 2412 has integrally formed access slots 2408. Access slots 2408 are arranged in a pattern to match latch arms 2110, 2111, and 2113 of bonnet top 1905. Lock lever body 2412 includes release button access hole 2406. On the interior of release button access hole 2406 is riser thread 2402. Riser thread 2402 is designed to mate with thread 2308 of locking ring 1910.

When assembled, lock lever disc 1912 is threaded into thread 2308 of locking ring 1910. Locking ring 1910 is positioned within square retaining hole 2115 of bonnet top 1905. The lock lever disc 1912 and the locking ring 1910 are held in place by latch arms 2110, 2111, and 2113. Rotation of lock lever 2404 is constrained by lock positioner 2102, unlock positioner 2104, and lock lever stop 2108. In an "unlock" position, the lock lever disc 1912 holds locking ring 1910 in a raised position. In a "lock" position lock lever disc 1912 retains locking ring 1910 in a lowered position. In the raised position, triangular lock teeth 2306 are not engaged with pinion collar lock teeth 2432, thereby allowing rotation of the pinion collar 1986. In the lowered position, the triangular lock teeth 2306 are engaged with pinion collar lock teeth 2432, thereby preventing rotation of the pinion collar, as will be further described.

Figure 25A:
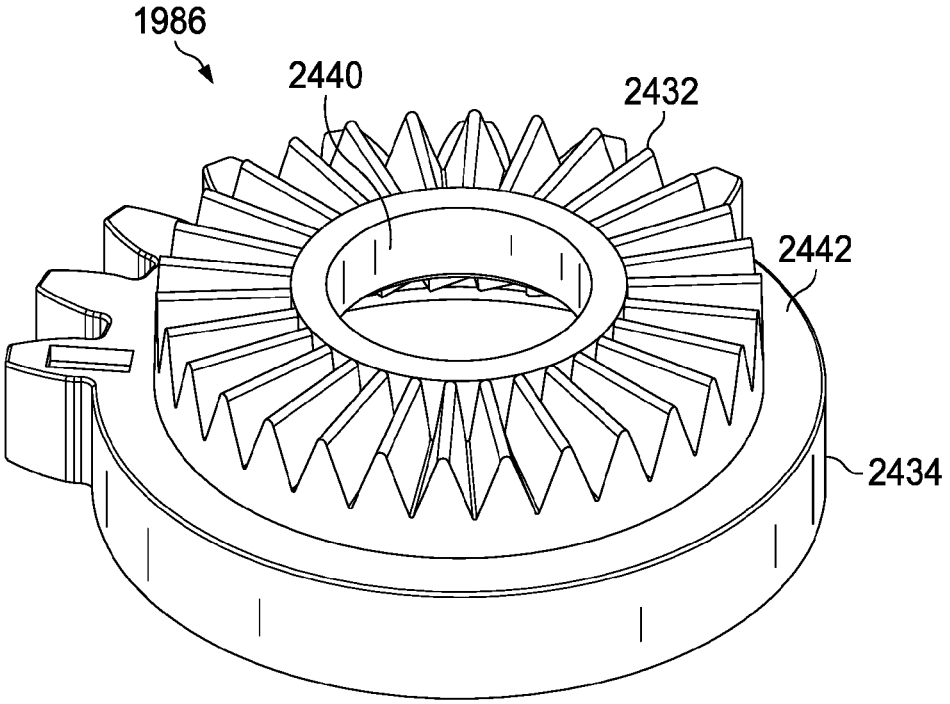
FIG. 25A is an isometric view of a component of a preferred embodiment.
Figure 25B:
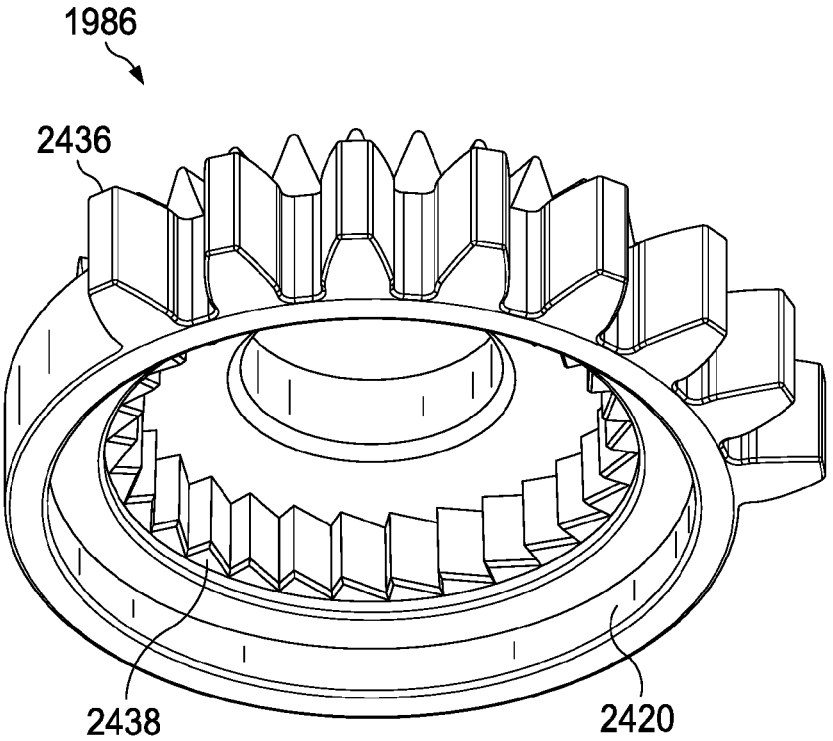
FIG. 25B is an isometric view of a component of a preferred embodiment.

Referring then to FIGS. 25A and 25B, pinion collar 1986 is described. Pinion collar 1986 includes cylindrical body 2434. Integrally formed with cylindrical body 2434, are pinion collar lock teeth 2432 surrounding release button access hole 2440. In a preferred embodiment, the pinion collar lock teeth are triangular. On the exterior surface of cylindrical body 2434 pinion teeth 2436 are formed. In a preferred embodiment, pinion teeth 2436 are gear teeth formed along a 120° radius on one side of cylindrical body 2434.

On the interior surface of cylindrical body 2434, ratchet teeth 2438 are formed. The ratchet teeth, in a preferred embodiment, are an inwardly facing radial saw tooth configuration.

Cylindrical body 2434 includes thrust surface 2442. Thrust surface 2442 is horizontally disposed and adjacent retaining ledge 1922. Cylindrical body 2434 further includes inside wall 2420. Inside wall 2420 is positioned adjacent cylindrical riser 2208 and constrains the cylindrical body to rotation about center pin hole 2293.

Rack positioner 1973, spring 1947, catch 1930, transfer plate 1941, and trigger 1939 are assembled and function as previously described. Pinion teeth 2436 engage rack teeth 1938 of rack positioner 1973. When the pinion collar is rotated, the rack positioner slides along a linear path, as previously described.

Figure 26A:
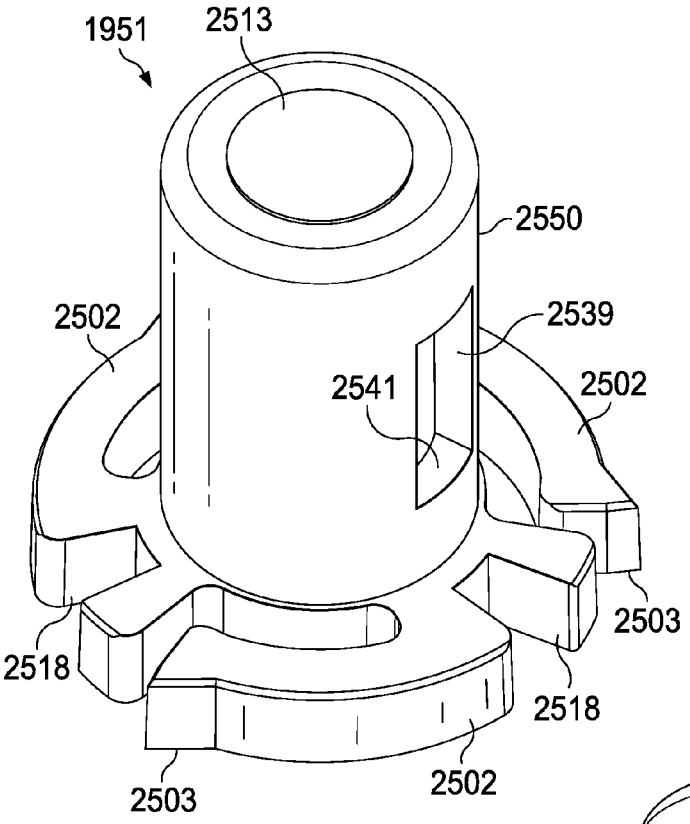
FIG. 26A is an isometric view of a component of a preferred embodiment.
Figure 26B:
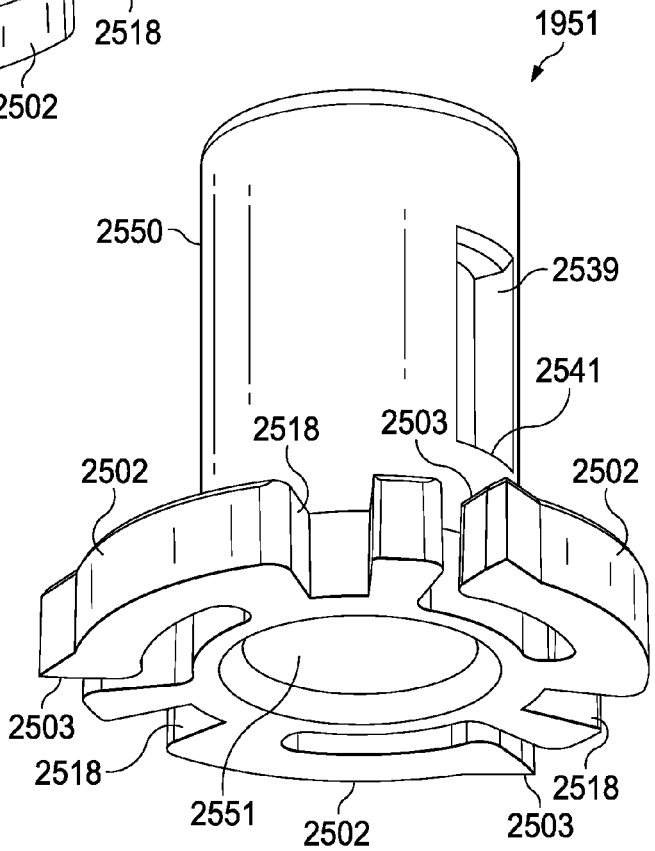
FIG. 26B is an isometric view of a component of a preferred embodiment.

Referring then to FIGS. 26A and 26B, release button 1951 is further described. Release button 1951 includes cylindrical button body 2550 capped by button surface 2513. Integrally formed with button body 2550 are two lock slots 2539, diametrically opposed. Each lock slot includes bottom surface 2541. Release button 1951 further includes riser guide slots 2518. In a preferred embodiment, there are three riser guide slots positioned at 120° angles around a central axis of the release button. Integrally formed with button body 2550 are three resilient pawl arms 2502 also arranged in 120° angles around a central axis of the release button. In a preferred embodiment, each resilient pawl arm includes a radial disposed catch 2503. Each resilient pawl arm is capable of exerting a radial force outward at each catch 2503. In a preferred embodiment, the release button is comprised of a flexible plastic, such as PVC, which imparts a spring like nature to each resilient pawl arm, which allows it to be compressed radially inward and yet exert a bias force radially outward when released.

Figure 27A:
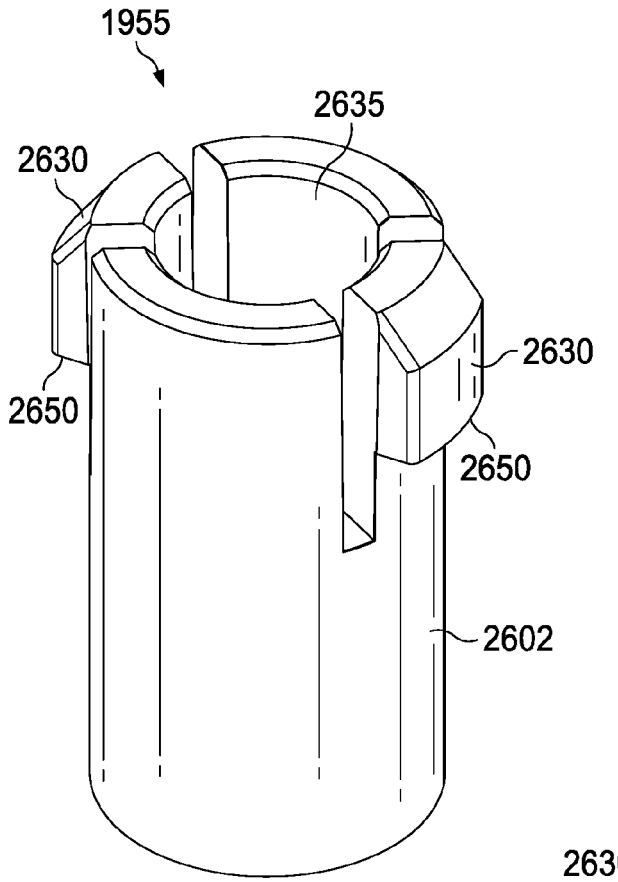
FIG. 27A is an isometric view of a component of a preferred embodiment.
Figure 27B:
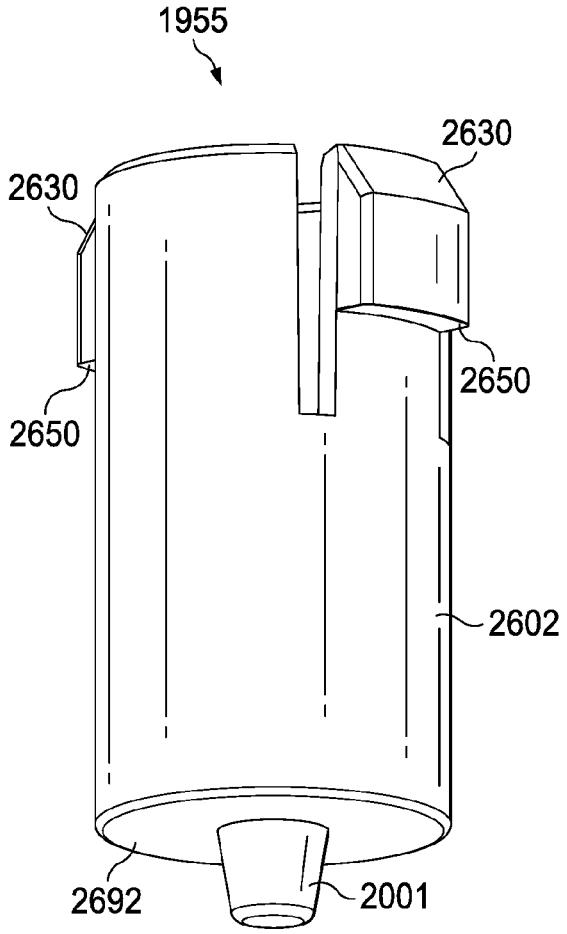
FIG. 27B is an isometric view of a component of a preferred embodiment.

Referring to FIGS. 27A and 27B, alignment sleeve 1955 is further described. Alignment sleeve 1955 includes cylindrical body 2602. Cylindrical body 2602 is bounded by base 2692 on which is integrally formed center pin 2001. Cylindrical body 2602 includes central hole 2635. In a preferred embodiment, cylindrical body 2602 also includes two diametrically opposed lock tabs 2630. Each lock tab 2630 includes a lock surface 2650. In a preferred embodiment, the lock tabs are resilient and capable of being compressed radially inwardly and yet be resilient sufficiently to return to their original position when released.

Referring then to FIGS. 19 and 20, when assembled, spring 1953 is centrally placed in hole 2635 of the alignment sleeve 1955 and center hole 2551 of the release button. The alignment sleeve is positioned within center hole 2551, such that lock tabs 2630 engage lock slots 2539, bringing lock surfaces 2650 into engagement with bottom surfaces 2541. Spring 1953 biases base 2692 against button surface 2513 and maintains lock surfaces 2650 against bottom surfaces 2541. When assembled, base 2692 is capable of being pressed axially toward button surface 2513, but will return to a position where lock surfaces 2650 are held against bottom surfaces 2541, when released.

Referring also to FIGS. 21A, 21B, 22A, and 22B, during assembly, center pin 2001 is positioned into center pin hole 2293 and riser guide slots 2518 are engaged with positioning stanchions 2291. Pinion collar 1986 is positioned such that release button access hole 2440 fits over and adjacent to button body 2550. Thrust surface 2442 is engaged with cylindrical riser 2208, such that catch 2503 of the resilient pawl arms 2502 engage with ratchet teeth 2438. Retaining ledge 1922 of positioning shelf 1921 is fitted against thrust surface 2442 and prevents upward axial movement of pinion collar 1986. Resilient pawl arms 2502, by virtue of engagement of catch 2503 with ratchet teeth 2438, permit rotation of the pinion collar in a clockwise direction, about its central axis, but do not permit rotation of the pinion collar in a counter clockwise direction. However, pressing release button 1951 disengages the resilient pawl arms from the ratchet teeth and allows rotation of the pinion collar about its central axis in either a clockwise or counter clockwise direction.

Referring to FIG. 18 and following, the function of undermount drawer slide clip mounting apparatus 1800 will be described.

In order to facilitate connection of the apparatus to the drawer rail, trigger 1939 is depressed thereby moving transfer plate 1941 linearly and causing catch 1930 to compress spring 1947. Arm 1918 is brought in contact with shoe 1812 and tab 1814 by advancing drawer rail 1806 linearly toward drawer face 1804. Upon engagement with arm 1918, trigger 1939 is released thereby allowing spring 1947 to move catch 1930 outwardly and into engagement with slot 1815.

In order to accommodate different sized slots in different drawer rails, linear movement of arm 1918 and catch 1930 are provided. Lock lever 2404 is rotated counter clockwise into an unlocked position. In the unlocked position, triangular lock teeth 2306 of locking ring 1910 are moved vertically out of engagement with pinion collar lock teeth 2432, thereby allowing pinion collar 1986 to rotate. Because of the action of resilient pawl arms and engagement of the catches with the ratchet teeth of the pinion collar, the pinion collar is only allowed to turn in a clockwise direction. In an unlocked position, rack positioner 1973 is permitted to move only in a proximal direction, and then in only discrete steps controlled by the pawl arms, toward drawer face 1804. This single direction ratchet movement facilitates quick adjustment and engagement of tab 1814 against catch 1930, thereby quickly achieving a secure connection. Upon achievement of a secure connection, lock lever 2404 is rotated approximately 360° allowing contact bar 2410 to override unlock positioner 2104. Contact bar 2410 also overrides lock positioner 2102 bringing it into a "locked" position adjacent lock lever stop 2108. In a "locked" position, triangular lock teeth of locking ring body 2301 are bought into engagement with pinion collar lock teeth 2404 of pinion collar 1986, thereby preventing rotation of the pinion collar and any further linear movement of rack positioner 1973. In its locked position, lock lever body 2412 also defeats any function of the release button 1951. In its unlocked position, lock lever body 2412 permits rotation of pinion collar 1986 and, due to engagement of pinion teeth 2436 with rack teeth 1938, also permits linear movement of rack positioner 1973. However, in its depressed position, release button 1951 moves resilient pawl arms 2502 downward into a coplanar position with base 2692 of alignment sleeve 1955 and out of engagement with ratchet teeth 2438. Absent the engagement of resilient pawl arms 2502 with ratchet teeth 2438, pinion collar 1986 is allowed to rotate in either direction, thereby allowing movement of rack positioner 1973 in both proximal and distal directions.

The lateral adjustment function, vertical adjustment function, and depth adjustment function of undermount drawer slide clip mounting apparatus 1800 are identical to those functions of undermount drawer slide clip mounting apparatus 1100 and a description of them will not be repeated here.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A drawer slide clip mounting apparatus for releasably connecting a drawer to a drawer slide assembly mounted in a cabinet carcass, comprising:

a base configured to be mounted to the drawer;

a bonnet slidingly connected to the base;

a rack positioner, having a sliding connection to the bonnet, configured to be releasably connected to the drawer slide assembly; and, a releasable locking means, operatively connected to the rack positioner, for controlling the sliding connection.

2. The drawer slide clip mounting apparatus of claim 1, further comprising:

a trigger lever pivotally connected to the rack positioner;

a guide dog slidingly connected to the rack positioner;

a spring bias between the guide dog and the rack positioner; and, a transfer plate connected to the guide dog and pivotally connected to the trigger lever;

whereby compression of the trigger lever effects a retraction of the guide dog and release of the trigger lever effects an extension of the guide dog.

3. The drawer slide clip mounting apparatus of claim 1, wherein the rack positioner further comprises a set of rack teeth, and wherein the releasable locking means further comprises:

a spring loaded release button rotationally fixed within and extending out of the bonnet;

the spring loaded release button comprising a set of engagement teeth;

a pinion collar adjacent the release button and configured to selectively engage the engagement teeth;

the pinion collar comprising a set of pinion teeth engaged with the set of rack teeth; and, whereby compressing the spring loaded release button disengages the set of engagement teeth from the pinion collar.

4. The drawer slide clip mounting apparatus of claim 3, wherein the set of engagement teeth comprises graduated teeth.

5. The drawer slide clip mounting apparatus of claim 3, wherein the set of engagement teeth further comprises at least one resilient pawl arm; and wherein the pinion collar further comprises a set of ratchet teeth engaged with the at least one resilient pawl arm.

6. The drawer slide clip mounting apparatus of claim 5, wherein the pinion collar further comprises a first set of lock teeth, and wherein the releasable locking means further comprises:

a locking ring, having a first set of positioning threads and a second set of lock teeth, constrained to vertical movement by the bonnet;

a lock lever, having a second set of positioning threads engaged with the first set of positioning threads, constrained to rotational movement by the locking ring;

whereby rotation of the lock lever in a first direction causes engagement of the first set of lock teeth and the second set of lock teeth; and, whereby rotation of the lock lever in a second direction causes disengagement of the first set of lock teeth from the second set of lock teeth.

7. The drawer slide clip mounting apparatus of claim 1, further comprising:

a housing mounted to the base; and, an adjustable plunger slidingly attached to the housing;

wherein the apparatus adjusts a depth position of the drawer relative to the cabinet carcass when the plunger is repositioned relative to the housing.

8. The drawer slide clip mounting apparatus of claim 7, wherein the housing comprises a carriage fixed to the base;

wherein the adjustable plunger comprises a plunger having a threaded guide arm and a thumbscrew threaded into the carriage and the threaded guide arm; and, wherein rotation of the thumbscrew in a first direction advances the plunger with respect to the carriage and rotation of the thumbscrew in a second direction retracts the plunger with respect to the carriage.

9. The drawer slide clip mounting apparatus of claim 1, further comprising a knob;

wherein the base further comprises a threaded spindle;

wherein the bonnet further comprises a first flange and a second flange adjacent the threaded spindle; and, wherein the knob is threaded onto the threaded spindle; and is between the first flange and the second flange;

whereby rotation of the knob clockwise moves the bonnet in a first direction with respect to the base and rotation of the knob counter-clockwise moves the bonnet in a second direction with respect to the base.

10. The drawer slide clip mounting apparatus of claim 3, wherein the bonnet further comprises a first set of serrated teeth, further comprising:

a ramp, constrained to sliding movement by the bonnet;

the ramp further comprising a ramp extension having a second set of serrated teeth engaged with the first set of serrated teeth; and, whereby movement of the ramp extension advances the ramp under the drawer slide to effect a vertical adjustment of the drawer.

11. A drawer slide clip mounting apparatus for releasably connecting a drawer to a drawer slide assembly mounted in a cabinet carcass, comprising:

a base, adapted to be attached to the drawer;

a bonnet, slidingly attached to the base;

a depth adjustment means, attached to the base between the drawer and the drawer slide assembly, for adjusting a depth distance;

a vertical adjustment means, attached to the bonnet between the drawer and the drawer slide assembly, for adjusting a vertical distance; and a lateral adjustment means, attached to the base between the drawer and the drawer slide assembly, for adjusting a horizontal distance.

12. The drawer slide clip mounting apparatus of claim 11, further comprising:

a release mechanism, attached to the bonnet, for releasably coupling the drawer slide clip mounting apparatus to the drawer slide assembly.

13. The drawer slide clip mounting apparatus of claim 12, wherein the release mechanism further comprises:

a rack positioner, having a set of rack teeth, constrained to slide in a depth direction by the bonnet;

a releasable catch assembly, attached to the rack positioner and adapted to engage the drawer slide assembly;

a release button, having a set of engagement teeth, constrained to vertical movement by the bonnet;

a pinion collar, having a set of pinion teeth and a first set of lock teeth, constrained to rotational movement about the release button by the bonnet;

the set of pinion teeth engaging the set of rack teeth; and, whereby the set of engagement teeth engage the first set of lock teeth when the release button is in a released position, thereby inhibiting movement of the rack positioner; and, whereby the set of engagement teeth disengage the first set of lock teeth when the release button is in a compressed position, thereby permitting movement of the rack positioner.

14. The drawer slide clip mounting apparatus of claim 13, wherein the release mechanism further comprises:

a locking ring body, having a second set of lock teeth;

a lock lever, having a first set of riser threads, positioned in the bonnet and constrained to rotational movement; and, a locking ring, having a second set of riser threads in contact with the first set of riser threads, constrained to vertical movement by the bonnet;

whereby rotation of the locking ring alternatively engages and disengages the first set of lock teeth from the second set of lock teeth.

15. The drawer slide clip mounting apparatus of claim 14, whereby rotation of the locking ring is inhibited by a set of positioning arms on the bonnet.

16. The drawer slide clip mounting apparatus of claim 14, wherein the second set of lock teeth are triangular; and, wherein the release button further comprises at least one triangular catch operatively disposed on a resilient pawl arm; and, whereby inhibiting movement of the rack positioner further comprises inhibiting movement in a proximal depth direction and permitting movement in a distal depth direction.

17. The drawer slide clip mounting apparatus of claim 13, wherein the first set of lock teeth are triangular and the set of engagement teeth are graduated.

18. The drawer slide clip mounting apparatus of claim 11, wherein the depth adjustment means comprises:

a carriage, having a threaded receiver, attached to the base;

a plunger, having a half-threaded trench, slidingly engaged with the carriage;

a thumbscrew, engaging the half-threaded trench, constrained to rotational motion by the carriage.

19. The drawer slide clip mounting apparatus of claim 11, wherein the vertical adjustment means comprises:

a ramp body, constrained to lateral movement within the bonnet;

an extension, having a first set of serrated teeth, integrally formed with the ramp body; and, a second set of serrated teeth, removably engaging the first set of serrated teeth, positioned on the bonnet.

20. The drawer slide clip mounting apparatus of claim 11, wherein the lateral adjustment means comprises:

a threaded spindle, fixed to the base;

a knob, threaded on the threaded spindle;

a set of flanges, configured to receive the threaded spindle, positioned adjacent the knob, and fixed to the bonnet.

* * * * *